US009315940B2

(12) United States Patent
Lee

(10) Patent No.: US 9,315,940 B2
(45) Date of Patent: Apr. 19, 2016

(54) SEAMED PRESS FELT INCLUDING AN ELASTIC CARRIER LAYER AND METHOD OF MAKING

(71) Applicant: AstenJohnson, Inc., Charleston, SC (US)

(72) Inventor: Henry Lee, Simpsonville, SC (US)

(73) Assignee: AstenJohnson, Inc., Charleston, SC (US)

( * ) Notice: Subject to any disclaimer, the term of this patent is extended or adjusted under 35 U.S.C. 154(b) by 89 days.

(21) Appl. No.: 14/390,538

(22) PCT Filed: Apr. 18, 2014

(86) PCT No.: PCT/US2014/034583

§ 371 (c)(1),
(2) Date: Oct. 3, 2014

(87) PCT Pub. No.: WO2014/172594

PCT Pub. Date: Oct. 23, 2014

(65) Prior Publication Data

US 2016/0069022 A1 Mar. 10, 2016

Related U.S. Application Data

(60) Provisional application No. 61/813,703, filed on Apr. 19, 2013, provisional application No. 61/873,516, filed on Sep. 4, 2013.

(51) Int. Cl.
*D21F 7/10* (2006.01)

(52) U.S. Cl.
CPC ..... *D21F 7/10* (2013.01)

(58) Field of Classification Search
CPC ..... B32B 5/02
USPC ..... 162/202, 289
See application file for complete search history.

(56) References Cited

U.S. PATENT DOCUMENTS

| | | | |
|---|---|---|---|
| 2,943,379 | A | 7/1960 | Foltz, Jr. |
| 3,392,079 | A | 7/1968 | Fekete |
| 3,815,645 | A | 6/1974 | Codorniu |
| 3,920,511 | A | 11/1975 | Grieves et al. |
| 4,476,902 | A | 10/1984 | Westhead |
| 5,268,076 | A | 12/1993 | Best et al. |
| 5,360,656 | A | 11/1994 | Rexfelt et al. |
| 5,785,818 | A | 7/1998 | Fekete et al. |

(Continued)

FOREIGN PATENT DOCUMENTS

WO 2012013438 2/2012

*Primary Examiner* — Mark Halpern
(74) *Attorney, Agent, or Firm* — Volpe and Koenig, P.C.

(57) ABSTRACT

A seamed press felt formed from a base fabric material including MD yarns arranged in two superimposed layers joined by the MD yarns at CD folds at opposing ends thereof to form a continuous unbroken tube-like structure. The MD yarns form loops at the folds to define a pintle channel. A generally planar yarn assembly including an array of polymeric yarns bonded to an elastic carrier material that is extensible by at least 1% is located inside the base fabric with the yarns of the array oriented in the CD. A high surface contact area material is bonded to the elastic carrier material at both exterior MD ends adjacent to the MD loops at the folds. Each of the MD ends is anchored in a fixed position adjacent to the loops at the folds. A pintle extends through the channel defined by intermeshing the loops from the opposing ends.

42 Claims, 13 Drawing Sheets

(56) References Cited

U.S. PATENT DOCUMENTS

| | | | |
|---|---|---|---|
| 6,699,366 | B2 | 3/2004 | Paquin et al. |
| 6,998,023 | B2 | 2/2006 | Crook |
| 7,118,651 | B2 | 10/2006 | Aldrich |
| 7,207,355 | B2 | 4/2007 | Lee |
| 7,220,340 | B2 | 5/2007 | Best |
| 7,892,402 | B2 | 2/2011 | Hawes et al. |
| 8,372,246 | B2 | 2/2013 | Hawes et al. |
| 2007/0163667 | A1 | 7/2007 | Crook |
| 2007/0254546 | A1 | 11/2007 | Despault |
| 2008/0135199 | A1 | 6/2008 | Rouhling |
| 2009/0090425 | A1 | 4/2009 | Hawes et al. |
| 2013/0020043 | A1 | 1/2013 | Hedou et al. |

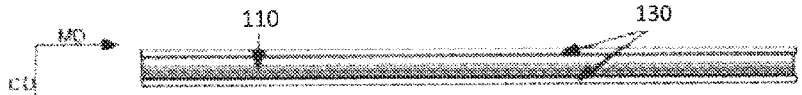
Figure 8C
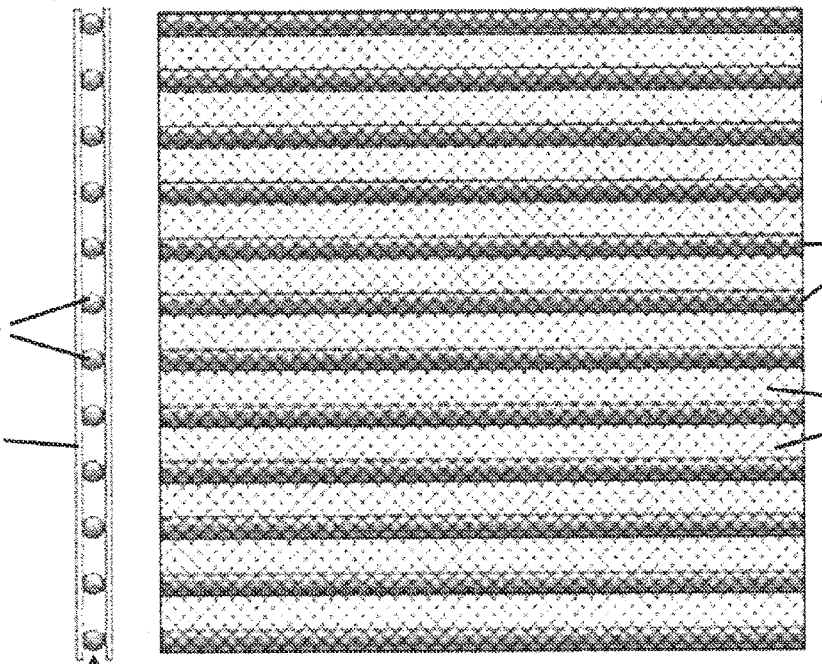
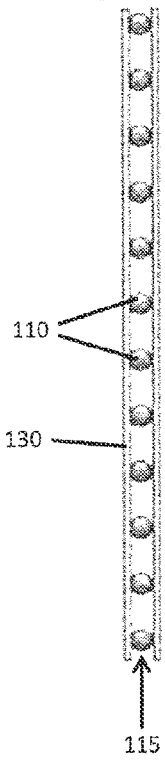
Figure 10B
Figure 10A
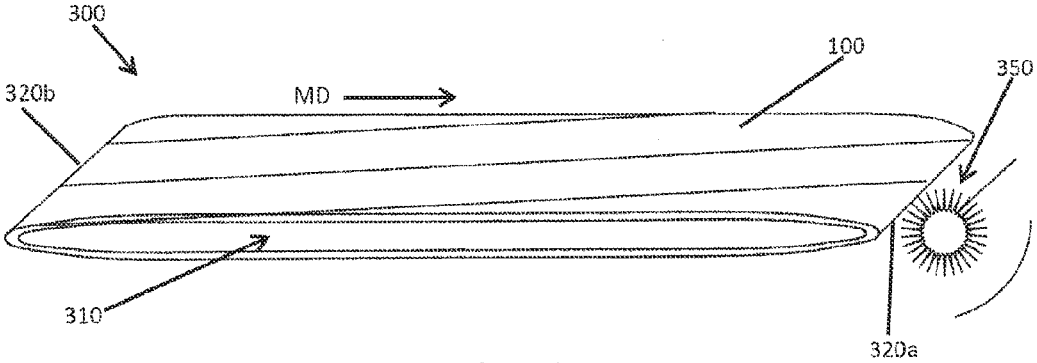
Figure 11

SEAMED PRESS FELT INCLUDING AN ELASTIC CARRIER LAYER AND METHOD OF MAKING

CROSS REFERENCE TO RELATED APPLICATIONS

This application is a 371 National Phase of PCT/US2014/034583, filed Apr. 18, 2014, which claims the benefit of U.S. Provisional Patent Application Nos. 61/813,703 filed Apr. 19, 2013 and 61/873,516 filed Sep. 4, 2013, the contents of all of which are incorporated by reference herein as if fully set forth.

FIELD OF THE INVENTION

The invention generally concerns seamed press felts for use in the manufacture of paper and similar products in a papermaking or like machine. It is particularly concerned with multi-layer press felts which include a nonwoven yarn array bonded to an elastic carrier. The novel construction assists to reduce batt shedding and sheet marking while maintaining high void volume, particularly with spirally wound press felts that include a seam region enabling the opposite ends of the press felt to be joined.

BACKGROUND OF THE INVENTION

The present invention concerns press felts for use in the press section of papermaking machines. In the manufacture of paper products, a stock slurry consisting of about 1% papermaking fibers and others solids dispersed in about 99% water is delivered at high speed and precision from a headbox slice onto a rapidly moving forming fabric, or between two forming fabrics, in the forming section of a papermaking machine. The stock is subjected to agitation and is dewatered by various means through the forming fabrics, leaving behind a loosely cohesive and wet web of fibers. This web is then transferred to the press section where a further portion of water is removed by mechanical means as the web, supported by one or more press felts, passes through at least one, and usually a series, of press nips where water is essentially squeezed from the nascent sheet and into the press felt. The water is accepted by the press felt and, ideally, does not return to the web. The resulting sheet is then passed to the dryer section which includes a series of rotatable dryer drums, or cans, that are heated by steam. The sheet is directed around and held in contact with the periphery of these drums by one or more dryer fabrics so that the majority of the remaining water is removed by evaporation.

Press felts play a critical role in the manufacture of paper products. The known press felts are produced in a wide variety of styles designed to meet the requirements of the papermaking machines on which they are installed, and the paper grades being manufactured. They are generally assembled using a woven or nonwoven base fabric structure into which is needled one and usually multiple layers of a fibrous nonwoven batt. The batt provides a smooth surface upon which the paper product is conveyed, acts as a reservoir to trap water expressed at the press nip, and provides a measure of resiliency to the press felt as it passes through the nip. The base fabrics are typically woven from monofilament, cabled monofilament, multifilament or similar multicomponent yarns; they may also be arranged as nonwoven planar arrays. The component yarns are usually comprised of an extruded polymeric resin, typically a polyamide.

The base fabrics may be of single layer or multilayer construction, or they may be formed from two or more layers which are laminated together. They may be woven endless, so that the resulting fabric resembles a tube with no seam; such fabrics must be prepared to the length and width of the machine for which they are intended, and must be slipped onto the press section in a manner similar to a sock. An example of such a fabric is provided in U.S. Pat. No. 7,118,651. In a variant modified endless weaving technique, the weft yarns are used to form seaming loops at the widthwise fabric edges during manufacture; when installed on the papermaking machine, these yarns will be oriented in the intended machine direction (MD) allowing the fabric to be joined by bringing the loops from each side together and inserting a pin, or pintle, through the resulting channel formed by the intermeshed loops. An example of a modified endless woven fabric may be found in U.S. Pat. No. 3,815,645. The base fabrics may also be flat woven, using one or more layers of warp or weft yarns; a seam is typically formed at each end allowing the fabric to be joined on the machine. An example of a flat woven base fabric may be found in U.S. Pat. No. 7,892,402. All of the above constructions require that the base fabric be woven to the full width and length of the machine for which they are intended; this is a time-consuming process and requires high capital investment in wide industrial looms. In an effort to reduce manufacturing time and costs, so-called "multiaxial fabrics" have recently been introduced for the production of press felts.

Multiaxial press felts are well known and are described in U.S. Pat. No. 5,360,656; U.S. Pat. No. 5,268,076; U.S. Pat. No. 5,785,818 and others. The base fabrics of these press felts are comprised of a plurality of spirally wound and edgewise joined turns of a material strip including at least machine direction (MD) oriented yarns. The material strip is usually a flat woven fabric which is narrower than the width of the intended base fabric of which it is a component; it has also been proposed to use nonwoven arrays of MD yarns as the material strip component. Regardless of whether the component is woven or nonwoven, during assembly each turn of the material strip is directed about two opposing rollers such that its component MD yarns are canted at a small angle that is from about 1° to about 8° to the intended MD of the finished fabric; see prior art FIG. 1. Each successive turn of the material strip is edgewise bonded to that laid adjacent to it so as to build up a continuous tube-like base fabric of desired width and length. When removed from the assembly rollers and laid flat, the tube has continuous top and bottom surfaces joined at cross-machine direction (CD) oriented fold regions at each of the two opposing ends; see prior art FIG. 2. The completed multiaxial base fabrics are typically one of a two, three or four layer construction comprising the top and bottom surfaces of the spirally wound continuous tube, and optionally at least one additional flat fabric layer, located either interior to the flattened tube, or on top of one or both exterior surfaces. The assembled base fabrics may later be provided with a seam to facilitate their installation on the machine for which they are intended.

FIG. 3 shows the two opposing edge regions of the spirally wound prior art double layer woven structure of FIG. 2 with a portion of the CD oriented yarns removed at the opposing fold regions. This exposes the MD oriented yarns of the structure so that the yarn loops may be used to form a seam in the fabric as illustrated in FIG. 4. This Figure shows a double layer fabric that has been seamed by intermeshing the yarn loops formed by the MD yarns at the fold region and inserting a pintle across the length of the channel thus provided.

Regardless of its construction, the primary function of the press felt is to act as a reservoir to transport water expressed from the paper sheet as it passes through a press nip in the press section of the papermaking machine. The base fabric must therefore provide a measure of void volume, or empty interior space, into which the water can pass, and be held, until it can be removed at a later process stage. This space can be provided either by the weave structure of the base fabric in the manner described in U.S. Pat. No. 7,207,355 and as shown in cross-section in prior art FIG. 5, or the base fabric may include at least one additional fabric structure, such as a woven or nonwoven fabric, as mentioned above. Other constructions are possible.

Although spirally wound woven press felt base fabrics formed in the manner illustrated in FIGS. 1 to 5 have proven successful in many applications, they suffer from several disadvantages.

First, despite the fact that the component strips are narrow structures woven using a high speed loom, producing them is time consuming and costly. Weaving defects and other non-uniformities are often introduced during the production process because the weaving is often intermittent, requiring frequent process interruptions for feed-yarn resupply. These interruptions impart non-uniform areas into the woven material.

Second, the "knuckles" formed by the interwoven yarns in the component strip as they crimp about one another will become flattened due to the repeated passage of the fabric through the press nip(s), thus compacting the fabric. This compaction will affect dewatering performance over time as these fabrics typically have a "break-in" period during which they slowly adjust to their environment before they reach a steady state of performance. During this break-in period, their dewatering performance, void volume, permeability and other physical properties will change and it is generally necessary for the paper manufacturer to run the machine more slowly than would otherwise be desired and with frequent adjustment until a steady state of performance is reached. In addition, the interwoven yarns pass into and out of the surface planes in the weave structure, which ultimately reduces contact between the batt surface and paper sheet, and provides only a fraction of the yarn surface for planar sheet support. Such localized pressure points of the exposed crimped yarn knuckles can produce undesirable paper sheet marking. It will be apparent that such irregularities are undesirable as the base fabric and batt together should provide uniform planar support to the sheet for effective water removal and sheet smoothness.

Third, because the entire spirally wound fabric is woven according to the same weave pattern, interference patterns appear at locations where the warp and weft yarns from the opposing sides of the double layer tubular structure are not in exact alignment. Interference patterns are created because regions of relatively low and high yarn densities are formed as a result of the misalignment of the crimped yarns in the two opposing sides (i.e. they are not in exact registration with one another and move in and out of a horizontal plane as they nest between one another). If this situation is not addressed in some manner, the resulting press felt will also have areas of low and high yarn density which will be regularly spaced in both the length and width direction. This creates several problems, including: uneven water removal and sheet marking due in part to non-uniform batt adhesion. Batt fibers adhere more aggressively to base fabric regions where yarn densities are relatively high in comparison to areas where they are lower, resulting in fiber shedding where anchorage is comparatively poorer. This in turn will affect the uniformity of the fabric and thus its overall ability to evenly dewater the sheet without marking it.

Fourth, there are several seam related issues in the known seamed press felts. These include the lack of uniformity in the loops used to form the seam resulting in an uneven channel size, making the insertion of a pintle more difficult. Further, the physical characteristics in the seam area should, to the greatest extent possible, be the same as the remainder of the fabric. As the base fabric and any batt attached to it must usually be cut to install the seam, the physical properties of the seam region, including its surface uniformity, resistance to abrasive wear, and its overall dewatering and resiliency characteristics, are frequently the source of sheet marking or fabric failure. The seam region is thus usually recognized as the most critical area of the finished fabric.

During seam installation, at least a portion of the batt (and occasionally a portion of the component yarns of the woven or nonwoven base fabric) is cut to open the seam loop region and allow for removal of unwanted material adjacent the MD yarn loops. A "flap" of batt material is thus formed which must be securely reattached to the fabric so as to cover the seam region when the fabric is in use. This flap of material creates various problems in the finished press felt. As the batt flap begins to wear during use, some of the base fabric yarns at the cut edge may become loose and begin to pull out of the woven structure and batt, a phenomenon commonly known in the art as "stringing". These exposed yarns will mark the sheet and promote more rapid degradation of the press felt at the seam region. In addition, because the base fabric is load bearing, this load may cause the base to retract back from the seam area, producing an open seam gap, which is also undesirable as it causes marking on the sheet.

Various efforts have been made to ensure secure batt anchorage where it is normally cut during seam installation and minimize discontinuities in the seam region. The solution most frequently used has been to insert so-called "stuffer yarns" into the base fabric adjacent the seam. These stuffer yarns are usually multicomponent yarns which, due to their larger surface area in comparison to monofilaments, offer greater opportunity for anchorage of the batt material during a needling process. Stuffer yarns have, in the past, been woven into the seam area on-loom (in full-width woven fabrics) allowing them to be located in a relatively fixed position. However, in multiaxial base fabrics, the stuffer yarns cannot be inserted during weaving and must instead be manually installed after the full width base fabric is assembled. Because both the MD and CD yarns in these fabrics are oriented at small angles of from 1° to 8° to the intended machine and cross-machine directions, the stuffer yarns are difficult to maintain in a constant position with the accuracy and permanency of those which are woven-in during weaving. As a result, the stuffer yarns tend to "wander" along the CD edge of the base fabric adjacent the seam loops, making the seam difficult to close during felt installation, reducing the effectiveness of batt anchorage at this area, and creating opportunity for discontinuity in the seam region.

DISCUSSION OF THE PRIOR ART

The majority of base fabric constructions presently used in the known press felts are each woven, which makes them complex and time consuming to produce, and introduces various difficulties as have been described above in detail. Various nonwoven constructions have been proposed in an effort to eliminate the need to weave these fabrics. For example, U.S. Pat. No. 2,943,379 discloses a press felt base fabric including a single array of longitudinally oriented yarns interlocked by needling batt to one or both sides. U.S. Pat. No. 3,392,079 discloses a press felt comprising a nonwoven array of yarns each having a fuzzy character and a batt that is oriented at right angles with respect to these yarns. U.S. Pat. No. 3,920,511 teaches a base fabric formed from a plurality of lapped layers of longitudinally oriented fibers consolidated by needling. U.S. Pat. No. 4,781,967 discloses a nonwoven press felt composed of modular layers, each of which is comprised of a parallel array of yarns supported by at least one layer of batt material, and each of which is oriented so as to be nonparallel to the next.

U.S. Pat. No. 6,699,366 discloses a press felt base fabric comprised of a nonwoven net-like structure mesh which is either spirally wound in non-overlapping turns so as to build up an integral structure, or which uses individual strips of nonwoven mesh laid in side-by-side abutting relation to form a plurality of endless loops of equivalent length.

U.S. Pat. No. 6,998,023 discloses a press felt consisting of a base fabric (carrier layer) and at least 2 nonwoven layers comprised of "ultra-coarse" non-continuous fibers on the paper surface which are oriented at small but opposite angles to the MD to provide a bi-axial construction with a cross orientation.

US 2007/0254546 discloses a nonwoven textile assembly formed from a uniform array of parallel yarns to which an adhesive is applied, and a second component such as another yarn array, a nonwoven mesh or scrim.

US 2007/0163667 describes a seamed press felt which includes an inner sleeve, which can be a woven or nonwoven base structure, and an outer sleeve of spirally wound MD yarn which is wound continuously around the inner sleeve. Batt material is needled into the inner sleeve so that it is located between the inner and outer sleeve. The inner sleeve can be one of an open mesh scrim, an extruded mesh, a thin single layer woven fabric, joined spun bonded yarns, films and the like but should be a material having some measure of CD strength and stability with minimal MD yarns.

WO 2012/013438 proposes a press felt including a first fiber layer which is a stitch bonded material and at least one further layer such as a woven base, a bonded yarn array or batt material, in which the first fiber layer is bonded to the at least one further layer.

U.S. Pat. No. 7,220,340 discloses a nonwoven dryer or press fabric comprising a layer of MD yarns overlaid with a layer of CD yarns in which the yarns are connected positively to one another at crossing points by means of an adhesive, snap-fit (peg and hole) or by localized melting at the crossing points.

U.S. Pat. No. 8,372,246 (the '246 patent) discloses the insertion of a layer of a nonwoven material into the interior area between the upper and lower layers of a spirally wound press felt base fabric, specifically to reduce the appearance of interference patterns (and their attendant problems of batt shedding, uneven dewatering, surface non-uniformities, and others) between these two layers. The nonwoven layer is said to consist of materials such as a knitted fabric, an extruded mesh, MD or CD yarn arrays, and full width or spirally wound strips of nonwoven fibrous material. The nonwoven layer is said to comprise a sheet or web structure bonded together by entangling fiber or filaments mechanically, thermally or chemically and may be made of any suitable material such as polyamide or polyester resins and then located between the upper and lower woven layers by any means known to those skilled in the art. However, this disclosure does not address any of the above deficiencies relating to the seam region of the resulting multiaxial press felt, nor does it disclose any specifics as to methods of adjusting interior void volume, providing vibration resistance, or improving the overall uniformity of the finished press felt. In particular, the '246 patent does not address means of adjusting physical properties of the nonwoven layer so as to improve seam uniformity.

It would be desirable to provide a press felt base fabric construction which addresses the known problems of sheet marking, batt shedding, fabric compaction and void volume loss in the known press felt constructions, and particularly multiaxial press felt constructions, while providing a seam that is non-marking and resilient over its useful life. The base fabric constructions of the present invention address some or all of these issues.

SUMMARY OF THE INVENTION

In one aspect, a seamed press felt is provided comprising a base fabric material, which can be woven or non-woven, having an MD length and CD width including at least MD oriented yarns and arranged in two superimposed layers joined by the MD oriented yarns at CD oriented fold regions at each of two opposing ends thereof in order to form a continuous unbroken tube-like structure. The MD oriented yarns form loops at the fold regions to define a uniform channel extending the CD width of the press felt. A generally planar yarn assembly including an array of mutually parallel and regularly spaced polymeric yarns, each bonded to an elastic carrier material that is extensible by at least 1% of a relaxed length thereof is provided, with the generally planar yarn assembly being located inside the base fabric, extending from a first to a second CD oriented fold region and is oriented such that the yarns of the array are oriented in the CD of the press felt. Additional ones of the generally planar yarn assemblies can optionally be located on one or both exterior sides of the base fabric. A high surface contact area material is bonded to the elastic carrier material at an exterior MD edge to form ends of the yarn assembly that are located adjacent to the loops formed of the MD oriented yarns at the fold regions to form MD ends of the generally planar yarn assembly that extend in the CD width direction. Each of the MD ends is oriented parallel to the loops of the MD oriented yarns and is anchored in a fixed position adjacent to the loops at each of the fold regions. A pintle extends through the uniform channel defined by intermeshing the loops from the two opposing ends to form a seam.

The carrier material is preferably an elastic, stretchable sheet-like material such as a nonwoven scrim, a stretchable membrane, film or woven elasticized yarns. The high surface contact area material (HSCAM) is preferably arranged parallel to the yarns of the array. In the preferred embodiment, the generally planar yarn assembly is elastically extensible or stretchable by from at least 1% to 10%, or more, of its relaxed length.

The HSCAM of a first MD end of the generally planar yarn assembly is located parallel to, and preferably interior to, the seam loops formed by the MD yarns at a first fold region of the base fabric. The generally planar yarn assembly extends uniformly over at least the flattened interior length of the base fabric such that the HSCAM at its second outside end is correspondingly located and secured parallel to, and preferably interior to, the seam loops at the second folded edge.

The locations of the MD ends of the generally planar yarn assembly with the high surface contact area material is preferably precisely controlled so that its position in or adjacent to the seam loops is precisely maintained in a fixed position during or following assembly or insertion into the base fabric. Preferably, when the seam is closed, the HSCAM at the MD ends of the generally planar yarn assembly contact an MD outer surface of the loops from the opposing end of the base fabric. In the fixed position, the MD ends preferably remain within 1 mm of the MD outer surfaces of the loops from the opposing end of the base fabric. Preferably, the generally planar yarn assembly is anchored to the base fabric material adjacent to the loops and the HSCAM extends at least partially into the loops. Preferably, for a woven base fabric, the MD ends extend past a last CD yarn of each of the superimposed layers adjacent to the loops. Preferably, the generally planar yarn assembly is anchored to the base fabric material at least in an area adjacent to the MD ends so that the exterior MD edge extends a predetermined uniform distance into or over the loops. Preferably, the HSCAM does not wander or deviate from the fixed position by a distance greater than a width of the pintle that extends through the loops of MD oriented yarns.

In a preferred aspect of the invention, the generally planar yarn assembly is formed from a first outside yarn panel, at least one interior yarn panel, and a second outside yarn panel. The first and second outside yarn panels include multicomponent yarns or other HSCAM yarns at an exterior MD edge that extend in a position located adjacent to the CD oriented folds. The multicomponent yarns or other high surface area material yarns having a yarn to yarn spacing that is the same as the array of mutually parallel and regularly spaced polymeric yarns of the interior yarn panel. The first and second outside yarn panels have a bonded connection to edges of the at least one interior yarn panel; additional interior yarn panels also have a bonded connection to one another.

One of the multicomponent yarns or other HSCAM yarns in the first outside panel is located in an interior of the first fold region of the base fabric, parallel to, and in contact with interior surfaces of the MD yarn loops at the CD oriented first fold region. Additional HSCAM yarns can be located on an exterior surface of the base fabric such that the one of the multicomponent yarns or other HSCAM yarns is located adjacent the last CD yarn in the base fabric at the yarn loops at the first fold region. Additionally, one of the multicomponent yarns or other HSCAM yarns in the second outside panel is located in an interior of the second fold region of the base fabric, parallel to, and in contact with interior surfaces of the MD yarn loops at the CD oriented second fold region. Optionally, a second generally planar yarn assembly can be located on an exterior surface of the base fabric such that the one of the multifilament yarns or other HSCAM yarns is located adjacent the last CD yarn in the base fabric at the yarn loops at the second fold region.

The generally planar yarn assembly is uniformly stretched so as to remove any creases or other planar deformations during assembly. Preferably, the elastic carrier material is stretched at least 1%, and more preferably from 2% to 10%.

In another aspect, the press felt is a nonwoven multiaxial press felt. The base fabric comprises a plurality of spirally wound turns of a first fabric structure, the first fabric structure including a first planar yarn array of the MD oriented yarns comprising single polymeric monofilaments arranged at a first density, at least two layers of a hot melt adhesive web having a first melting temperature, one of the layers of the hot melt adhesive located on each side of the first planar yarn array, and a layer of an elastic carrier material located over each of the layers of the hot melt adhesive web, which is preferably a fine fibrous scrim. The first yarn array, the two layers of the hot melt adhesive web, and the layers of the fine fibrous scrim material located over the two layers of the hot melt adhesive web are heated above the first temperature to form the first fabric structure. Each adjacent one of the wound turns of the first fabric structure is oriented at an angle to the MD and is bonded to an adjacent turn to provide a flattened continuous double layer tube.

Preferably, the base fabric of the press felt according to the invention includes at least two yarn arrays that are oriented generally orthogonal to each other, within about 5° of true perpendicular, based on the angle of the spirally wound MD array.

Here, the generally planar yarn assembly is located within the interior of the flattened continuous double layer tube formed by the spirally wound turns of the first fabric structure. Optionally, additional generally planar yarn assemblies can be located on an exterior surface of the double layer tube.

Preferably, the polymers comprising the yarns of the first and second arrays are polyamides. More preferably, the yarns of the first array are comprised of polyamide-6 (PA-6) while the yarns of the second array are comprised of polyamide-6/10 (PA-6/10).

Preferably the yarns of the first array are single circular cross-sectional shaped monofilaments having a diameter of from about 0.3 mm to 0.6 mm and are preferably arranged to provide a yarn density of from 15 to 40 yarns/inch (5.9 to 15.7 yarns/cm). More preferably, the diameter of the yarns in the first array is about 0.5 mm.

Preferably, the yarns of the generally planar yarn assembly are single circular cross-sectional shaped monofilaments having a diameter ranging from about 0.3 mm to 0.6 mm and are preferably arranged to provide a yarn density of from 15 to 40 yarns/inch (5.9 to 15.7 yarns/cm). More preferably, the diameter of the yarns of the generally planar yarn assembly is less than the diameter of the yarns in the first array and are arranged to provide a yarn density that is greater than the yarn density of the first array. Preferably the diameter of the yarns of the generally planar fabric structure is about 0.4 mm.

Alternatively, the yarns of the generally planar yarn assembly are cabled monofilaments having a diameter, d, in the range of 0.1 to 0.3 mm, and may be cabled in one of a d×2×2, d×2×3 or d×3×3 arrangements.

Preferably, the diameter of the yarns in the first array is greater than that of the yarns in the generally planar fabric structure. Alternatively, the diameter of the yarns in the first array and the generally planar fabric structure is the same.

Preferably, the density of the yarns in the first planar yarn array is less than the density of the yarns in the generally planar yarn assembly. Alternatively, the density of the yarns in the first array and generally planar yarn assembly is the same.

Preferably, the melting temperature of the hot melt adhesive web is less than the melting temperature of the elastic carrier material.

Preferably, the elastic carrier material is a fibrous scrim material that is a thermally bonded nonwoven open network of continuous polymeric fibers having a dtex (mass in grams per 10,000 meters of fiber) in the range of 1 to 10, and an air permeability of from about 100 cfm (~1560 $m^3/m^2/hr$) to 2000 cfm (~31,000 $m^3/m^2/hr$) or more. Preferably, the scrim fibers are comprised of polyamide. Preferably, the polyamide is polyamide-6/6 (PA-6/6).

Preferably, the scrim material has a tensile strength of at least 5 lb/in, and more preferably is in the range of 5 to 10 lb/in.

A preferred assembly method provides that the planar yarn assembly is located at least inside the base fabric with the first end of the planar yarn assembly extending at least partially into the MD yarn loops at the fold region. The base fabric is collapsed so that it forms a flattened tube with two folded ends and the first end of the planar yarn assembly is clamped in position so that a first component yarn, which is preferably a HSCAM yarn, is adjacent or extending partially into the MD yarn loops of the base fabric, and then it is stitched, sewn or otherwise bonded to the first folded end to the base fabric. The planar yarn assembly is then extended towards the opposite fold region of the base fabric, and as the MD length of the yarn assembly is preferably at least 1% less than an overall length of the flattened interior of the base fabric, the planar yarn assembly is stretched across its CD width so as to stretch the elastic carrier (with the laminated yarns attached to it) by an amount sufficient to bring the second end into position adjacent to the seam loops at the second folded end. The second end of the planar yarn assembly is then clamped in position so that a last component yarn is in the desired position adjacent or extending partially into the MD yarn loops of the base fabric, and the second end is then stitched, sewn or otherwise bonded to the base fabric. This stretching increases the distance between adjacent yarns in the assembly, thus increasing the void volume of the resulting structure by a small amount.

The assembly method ensures that the high surface contact area material is accurately and precisely placed at each of the two folds such that it does not move by more than a small amount from its orientation and fixed position parallel to the loops, at least partially filling this space.

One or more layers of nonwoven batt or similar material can then be needled into the assembly including the base fabric and elastic carrier layer to complete the press felt.

The high surface contact area material serves to securely anchor the batt at the seam location while maintaining seam loop and pintle channel uniformity, and the array of parallel yarns contribute to the void volume, dewatering performance, resiliency and overall uniformity of the resulting press felt.

BRIEF DESCRIPTION OF THE DRAWINGS

The foregoing Summary and the following detailed description and claims will be best understood when read in conjunction with the drawings which show the presently preferred embodiments of the invention. In the drawings:

FIG. 10A is a planar view of the first fabric structure provided in FIG. 7 showing the first (MD) yarn array oriented horizontally across the page including a layer of second scrim material laid over the first yarn array; FIG. 10B is a cross-section through the MD yarns of this structure located at the left; and FIG. 10C is a cross-section along an MD yarn provided at the top of FIG. 8A;

FIG. 11 provides a schematic illustration of a double layer base fabric structure formed from the first fabric structure presented in FIGS. 7, 9 & 10 following a spiral winding process and prior to assembly with a generally planar yarn assembly; a translating device to remove scrim material from between the yarns of the first fabric structure at the seam region following spiral winding is shown at right;

FIGS. 12A-C show the first fabric structure of FIGS. 10A-10C in which a portion of the first scrim material has been removed at one of the fold areas using the translating device in FIG. 9 to expose the MD oriented yarns of the first yarn array;

FIG. 18A is a planar view of an assembled first fabric structure with additional generally planar yarn assemblies arranged according to a third embodiment of the invention in which a first yarn assembly is located on the exterior surface of the double layer structure such as is presented in FIGS. 11 through 15 and a second yarn assembly is located in the open central area of the double layer structure; FIG. 18C is an end view of the MD yarns of this structure located at the left of FIG. 18A; and FIG. 18D is a cross-section along an MD yarn provided at the top of FIG. 18A;

in FIGS. 12A and 12B, these are shown as three multifilament yarns, arranged so that two are positioned proximate the outer edge of the assembly which will be located closest the seam loops of the base fabric, followed by a monofilament yarn, and then another multifilament. Various arrangements of the high surface contact area material components are possible.

DETAILED DESCRIPTION OF THE PREFERRED EMBODIMENTS

Figure 1:
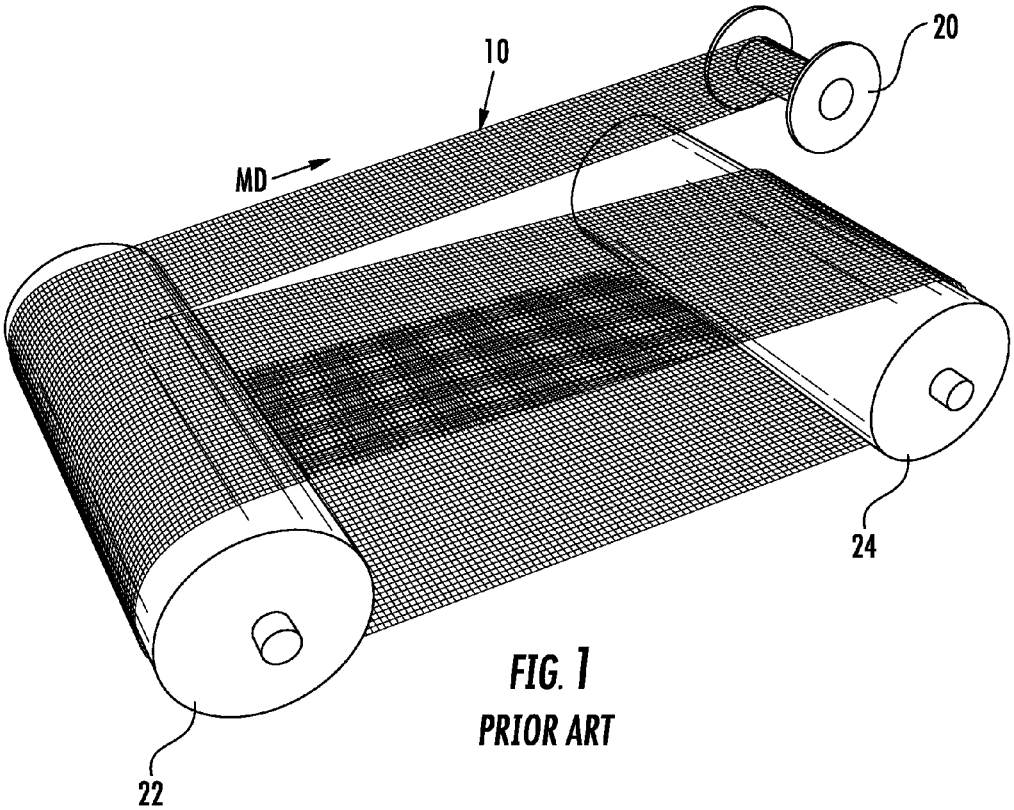
FIG. 1 PRIOR ART
FIG. 1 is an illustration showing a known spiral winding process in which a strip of relatively narrow fabric 10 is spirally wound from a feed source 20 between two opposed rolls 22, 24 to produce a desired width and length of base fabric. Each successive turn of strip 10 is bonded to that to which it is laid adjacent in the process to provide the base fabric.

Certain terminology is used in the following description for convenience only and is not limiting. The words "top," "bottom," "upper" and "lower" designate directions in the drawings to which reference is made. The words "interior" and "exterior" refer to directions within or outside of the two layers of the base fabric. A reference to a list of items that are cited as "at least one of a, b, or c" (where a, b, and c represent the items being listed) means any single one of the items a, b, or c, or combinations thereof. "A" or "an" refer to one or more of the item noted. "MD" refers to a machine direction in the papermaking machine from the headbox to the dryer section and is the longitudinal direction of the press felt. "CD" refers to the cross-machine direction, or a direction perpendicular to the machine direction in the plane of the fabric. The term "PS" refers to the paper side surface of the fabric, which is the surface upon which the paper product is carried through the papermaking machine. "MS" refers to the machine side of the fabric and is the surface opposite to the PS. Unless otherwise specified, the term "yarn" or "yarns" refers to a continuous length of either single or cabled polymeric monofilament such as would be used in the manufacture of the base fabrics of the invention, while the term "fiber" or "fibers" refers to relatively small diameter polymeric materials such as those commonly used in batt or scrim materials which fibers have a very small dtex (mass in grams per 10,000 meters of fiber). "Seam region" refers to the exposed yarn loops of the MD yarns at the CD fold areas at the opposing MD ends of the press felt. The term "array" refers to a generally planar group of mutually parallel yarns which are not interwoven or interconnected with one another by interlacing. The term "fibrous scrim" refers to a bonded cohesive open network of fine fibers made, for example, by spinning and thermally bonding continuous filaments of polyamide into a drapable, conformable textile like material whose component fibers having a dtex that is in the range of from 1 to 10 and an air permeability of from about 100 cfm (~1,560 $m^3/m^2/hr$) to about 2000 cfm (~31,000 $m^3/m^2/hr$) or higher. "Orthogonal" or "perpendicular" as used herein with respect to the CD and MD yarns means generally within about 85° to 95° based on the deviation from true perpendicular created by the spiral winding of the MD yarns in the first yarn array. The terms "left", "right", "up", "down" are used in relation to the drawings and have the meanings usually assigned. Additional definitions for terms used herein are as follows:

Additional Definitions

"Press felt base fabric": a woven or nonwoven assembly of yarns provided as an endless structure or continuous loop including two superimposed layers joined (when laid flat) at two opposing fold areas including continuous MD yarns passing around the folds. The assemblies can take the form of: a) an endless woven structure, b) a modified endless woven structure, c) a flat woven fabric folded at two locations to provide a double layer assembly, d) a fabric formed according to a multiaxial assembly process, or e) a nonwoven structure assembled to provide any of the previous assemblies. The present invention is applicable to all of the above, but it is particularly suitable for use in both woven and nonwoven multiaxial base fabric constructions. All of the base fabrics, with the possible exception of those which are endless woven, are post processed to provide seam loops formed by the MD oriented component yarns allowing the fabric to be joined and thus rendered endless. These base fabrics provide the finished press felt with the physical properties (strength, void volume, resiliency) necessary for it to survive the rigors of the machine environment in which it will be used, while providing a rugged carrier for the batt fibers.

"Elastic carrier layer": a layer or generally planar sheet of a somewhat elastic, stretchable material typically provided as an assembly of one or more individual panels of the same material joined in side-by-side relation. The carrier layer may be comprised of one of: an elastomeric membrane, a permeable film, an elastic nonwoven mesh, or a woven assembly of stretchable elastomeric yarns such as polyurethane yarns; it is preferably comprised of a nonwoven, loosely bonded fibrous scrim such as a web of fine polyamide fibers. One example is a Cerex PA-6/6 scrim (part no. G31-25-96). An array of yarns [a yarn assembly, see below] can be bonded to the elastic carrier layer in a lamination or similar process. The elastic carrier layer is provided in lengths sufficient to cover the CD width of the base fabric into which it will be installed, and in a width or plurality of widths that are joined together sufficient to extend over preferably 90% to 99% of the MD length of the base fabric (i.e. the elastic carrier layer must be capable of stretching in a preferred range by at least 1% to 10% of the MD length of the base fabric so as to cover the interior or exterior MD surface length). Additional preferred physical properties of the carrier layer are as described below.

"Yarn assembly": one or more strips or panels comprising an array of yarns, typically single or cabled monofilaments, bonded or laminated onto sheet or strip of an elastic carrier layer in mutually parallel relation with regular spacing. The yarn assembly is formed or assembled from a plurality of yarn panels to an MD length that is preferably 90% to 99% of the MD length of the base fabric or first fabric structure.

"Yarn panels": panels comprising an array of yarns, typically single or cabled monofilaments, bonded or laminated onto sheet or strip of the elastic carrier layer in mutually parallel relation with regular spacing.

"First and second outside yarn panels": the two outside end panels of the yarn assembly which are located adjacent the seam region in the interior or exterior of the base fabric. The first and second outside panels include a high surface contact area component at one of their outside edges which is oriented parallel to the yarns of the yarn assembly.

"High surface contact area material" or "HSCAM": a material strip or yarn component such as a multicomponent (i.e. multifilament or cabled monofilament) yarn or strip of fibrous batt or similar material having a comparatively greater surface area and thus significantly greater opportunity for batt anchorage during needling than a single monofilament.

Preferred Embodiments

Referring to FIGS. 7-20, several embodiments of seamed multiaxial press felts according to the invention are shown. The embodiments may include a woven or nonwoven base fabric to which at least one layer of a fibrous batt material is needled, and a method of making same.

In a first embodiment, the base fabric is comprised of at least two yarn arrays, each oriented perpendicularly to the other and arranged in a stacked or stratified manner. The first array is comprised of first yarns preferably having a first diameter or size and first yarn density (i.e. number of yarns per unit length). The first array is "sandwiched" between two sheets of an adhesive web, which has a first melting temperature. The first array and adhesive web are together sandwiched between two layers of an elastic carrier layer, preferably a fine fibrous scrim material, which has a second melting temperature that is higher than the first. The first array, together with the adhesive webs and fibrous scrims, are subjected to heat and pressure in a hot lamination process, the heat sufficient to melt the adhesive webs and bond the yarns of the first array to the fibrous scrim to provide a generally planar and cohesive first fabric structure; the fibrous scrim material imparts cohesive strength to the first array and its component fibers act to enhance the dewatering performance of the completed press felt.

A continuous length of this first fabric structure having a selected width [of about 1 m] is produced and is spirally wound in a longitudinal direction at a small angle, which is generally about 5° or less to the MD, according to known techniques so as to build up a continuous tube that is open in the center. Adjacent edges of successive turns of the first fabric structure are bonded to one another by one of welding, stitching or other known bonding means as they are spirally wound. This can be done, for example, in a similar manner to the construction discussed in connection with FIGS. 19A and 19B. The tube is then collapsed, or flattened, to bring the opposing surfaces of the tube together to form a double layer arrangement having an MD length and CD width and an the open central area inside the tube. Fold regions are prepared at the opposed lateral CD edges. Unbroken lengths of the first yarns at each of the fold areas are freed to provide loops which will be used at a later stage to form a seam region to allow the eventually assembled and finished fabric to be joined on the machine for which it is intended.

A second fabric structure, preferably in the form of a generally planar yarn assembly, is prepared including an array comprising second yarns, which may be either monofilaments or multicomponent yarns such as multifilaments or cabled monofilaments preferably having a second diameter or size equal to or less than that of the first yarns, and arranged at a selected second yarn density which is preferably equal to or greater than the first yarn density. However, it could be less than the first yarn density depending on the particular application and requirements. The second array is sandwiched between two sheets of the adhesive web having a first melting temperature. The second array and the sheets of adhesive web are then together sandwiched between two layers of an elastic carrier layer, preferably also in the form of a fine fibrous scrim material, which has a second melting temperature that is higher than that of the adhesive web. The second array, together with the adhesive webs and fibrous scrim, are then subjected to pressure and heat sufficient to melt the adhesive web and bond the yarns of the second array to the fibrous scrim to provide a cohesive generally planar yarn assembly, which is used as a second fabric structure. Multiple strips of selected length of the second fabric structure are then assembled edge to edge by joining adjacent strips to one another to build up a desired width; various bonding means such as welding, gluing or stitching may be employed for this purpose. This can be done, for example, in a similar manner to the construction discussed in connection with FIGS. 20A and 20B.

During assembly of the press felt base fabric, at least one layer including multiple strips of the second fabric structure laid edge to edge and bonded together to provide a selected length and width is then located in an interior open central area of the flattened continuous tube of the first fabric structure, and optionally on one or both one exterior surfaces of the flattened double layer arrangement.

A sufficient length and width of the second fabric structure is provided so as to fill the entire length and width of the interior open central area of the flattened double layer arrangement or, optionally, fully cover an exterior surface. Once the first and second ends of the structure are precisely located in the manner described in detail below, the second fabric structure is then loosely stitched to the double layer arrangement of first fabric structure adjacent to, and interior to, the fold region to retain the generally planar yarn assembly structure in position for subsequent assembly. The spirally wound double layer first fabric structure, and the second fabric structure, are then bonded together in a needling process to form a base fabric for a press felt by needling one or more layers of a nonwoven fibrous batt material into and through the assembly.

The needled base fabric assembly is then subjected to heatsetting and various other known finishing steps so as to stabilize it. Unbroken lengths of the first yarns at each of the fold regions located at the opposite ends of the flattened tube of the double layer structure are then freed from the batt fibers to provide yarn loops which will be used to provide a seam for the press felt. The fold areas include unbroken loops of first yarns which are used to form the final seam. Following these steps, the finished nonwoven press felt is ready for installation in the press section of a paper machine. The fabric may be installed by passing it through the press section at slow speed while attached to one end of the previous press felt, bringing together the opposed seam regions, intermeshing the loops formed by the first yarns of the first array at the fold regions, and then inserting a pintle or similar joining wire or device through the channel provided at the seam regions by the loops at the fold regions to close the fabric.

The base fabric used in the first embodiment of the press felt of the present invention is preferably assembled using a spiral winding process generally as described in U.S. Pat. No. 5,268,076 to Best et al. and U.S. Pat. No. 5,360,656 to Svensson et al., both of which are incorporated herein by reference as if fully set forth. FIG. 1 provides a schematic illustration of this process. As shown in FIG. 1, a length of textile material 10 is paid off a spool 20 or from a similar source and is spirally (or helically) wound about two opposing rollers 22, 24 so that the longitudinal edges of each successive turn either abut or overlap one another. During assembly, each adjacent turn is bonded to the next by a chosen bonding process, such as stitching, welding, gluing or other suitable means. The prior art textile material 10 used for this purpose was usually a woven textile produced on a high speed narrow loom, either as the spirally wound fabric is made, or as stock material prior to the spiral winding process. Each adjacent turn of material is laid parallel to the next and usually oriented or canted at a small angle to the intended longitudinal or eventual MD of the finished fabric as it is spirally wound. Once the desired width and length of spirally wound fabric has been obtained, the textile material is cut from the feed source and the loosely cohesive spirally wound fabric is removed from the spiral winding assembly apparatus. Following removal, the fabric may be laid flat to provide a double layer structure 30 with two opposing fold regions 32, 34 that define the respective ends 36, 38 so that the resulting tube-like base fabric now resembles that shown in FIG. 2.

Figure 2:
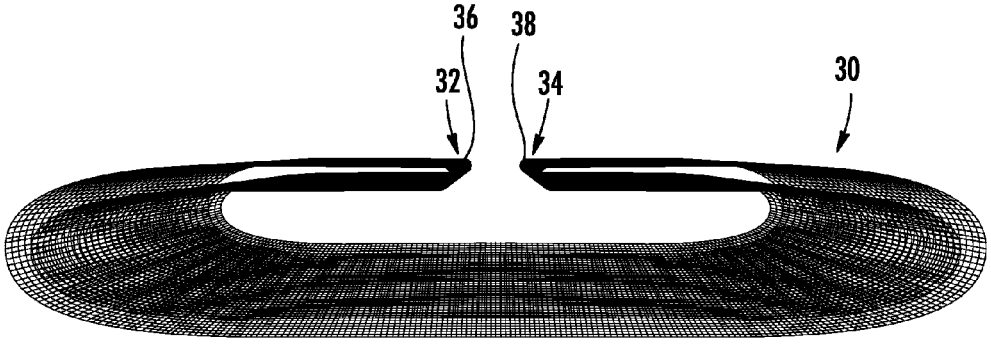
FIG. 2 PRIOR ART
FIG. 2 is a view of a continuous tube-like base fabric 30 including opposing fold regions 32 and 34; fabric 30 may be made from successive turns of the narrow fabric 10 in the manner illustrated in FIG. 1, or it may be produced by a modified endless weaving process, a flat weaving process where opposing ends of the flat woven cloth are joined to provide a continuous tube, or it may be a nonwoven cohesive assembly of yarns oriented in the length direction around the tube.
Figure 3:
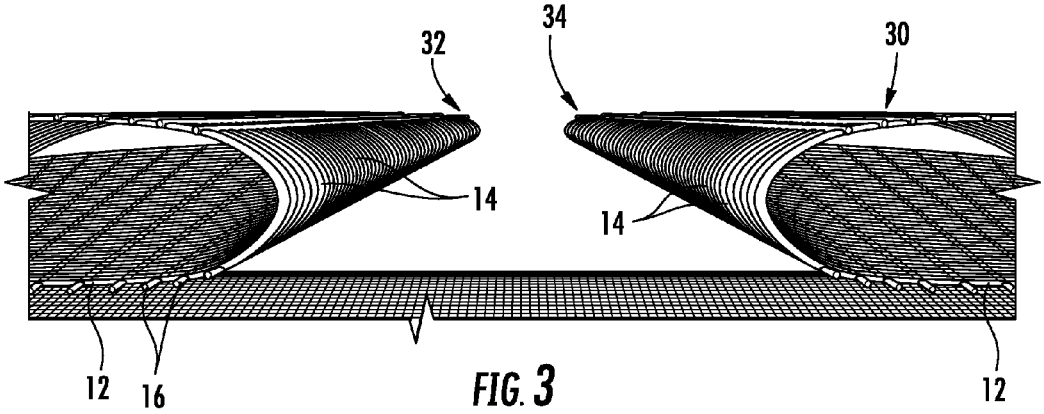
FIG. 3 PRIOR ART
FIG. 3 is an enlargement of the two folded edge regions of the base fabric presented in FIG. 2 which form the seam region in the prior art fabrics shown in FIGS. 1 and 2.
Figure 4:
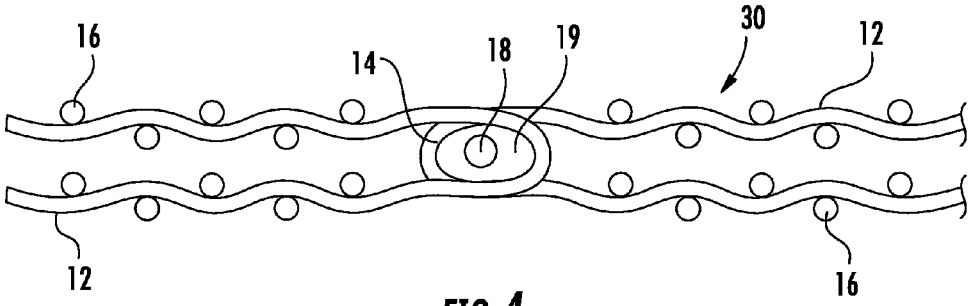
FIG. 4 PRIOR ART
FIG. 4 is a schematic illustration of the seam region in a prior art woven fabric such as presented in FIGS. 1 to 3 including a pintle to join the seam regions of the folded ends.

FIG. 3 shows the two opposing fold regions 32, 34 of the spirally wound prior art double layer woven structure 30 of FIG. 2 with a portion of the CD oriented yarns 16 removed at the opposing fold regions 32, 34. This exposes the yarn loops 14 formed by the MD oriented yarns 12 of the structure so that they are available to form a seam in the spirally wound fabric in the manner illustrated in FIG. 4. In FIG. 4, the double layer structure 30 has been joined by intermeshing the yarn loops 14 formed by the MD yarns 12 at the fold regions 32, 34 and inserting a pintle 18 across the length of the channel 19 thus provided.

Figure 5:
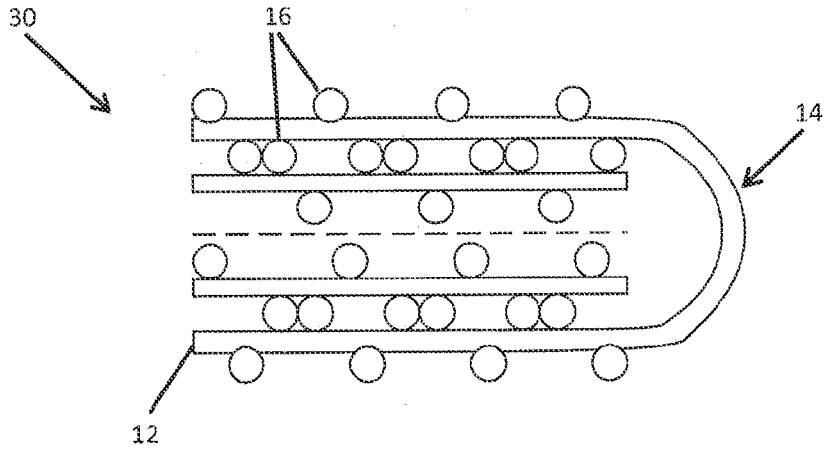
Figure 5 (Prior art)
FIG. 5 is an illustration showing a cross-section through a prior art high void volume woven base fabric according to Lee U.S. Pat. No. 7,207,355 at the seam loop area. The fabric includes two sets of MD oriented yarns, one of which is cut at the seam region to provide continuous loops of the second set of MD oriented yarns. The fabric of FIG. 5 illustrates one means of providing a relatively high void volume seamed base fabric.
Figure 6:
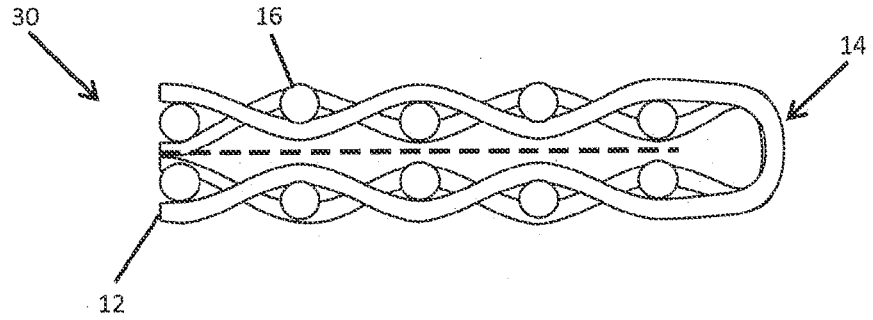
Figure 6 (Prior art)
FIG. 6 is a cross-sectional illustration of a single layer woven base fabric in which a fold has been created at one end so that the single layer is doubled back on itself to create a double layer structure. The fabric shown in FIG. 6 is preferably woven according to a plain weave and is an example of the type of weave and fabric that would be produced using the spiral winding method shown In FIG. 1 when collapsed on itself in the manner described in FIG. 2. The fold area of the cloth in FIG. 6 is similar to fold regions 32 or 34 in FIG. 2 when base fabric 30 is formed using the spiral winding method.

FIGS. 5 and 6 shown other prior art base fabric structures that can be used with the invention.

Figure 7:
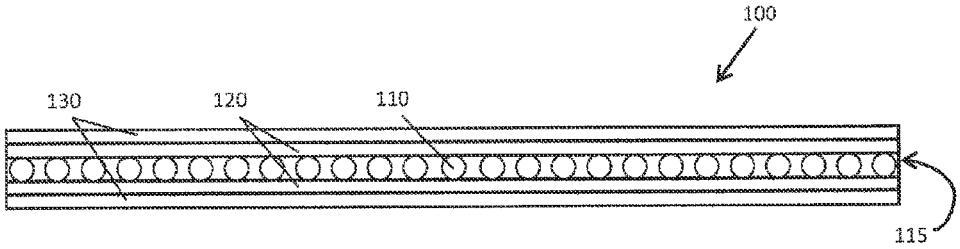
FIG. 7 is a diagrammatic illustration of a cross-section across the MD yarns of a first fabric structure which may be used in the assembly of base fabrics for nonwoven press felts according to the present invention.

FIG. 7 presents a cross-section taken across the yarns 110 in a first yarn array 115 of a first fabric structure 100 used in the assembly of the press felt base fabrics in an embodiment of the present invention. The first fabric structure 100 is spirally wound in the manner described in relation to FIG. 1 so that the yarn array 115 is oriented at a small angle, typically from about 1° to 5° to the longitudinal direction, or MD, of the base fabric. As shown in FIG. 7, the first fabric structure 100 is provided as a continuous strip of an array 115 of polymeric monofilament yarns 110 each of which is parallel to the next and regularly spaced apart at a desired spacing, which spacing may be adjusted according to need. The first and second fabric structures are essentially the same, except that the yarn types, size and density will differ; except where indicated, the following description applies equally to both.

Figure 8:
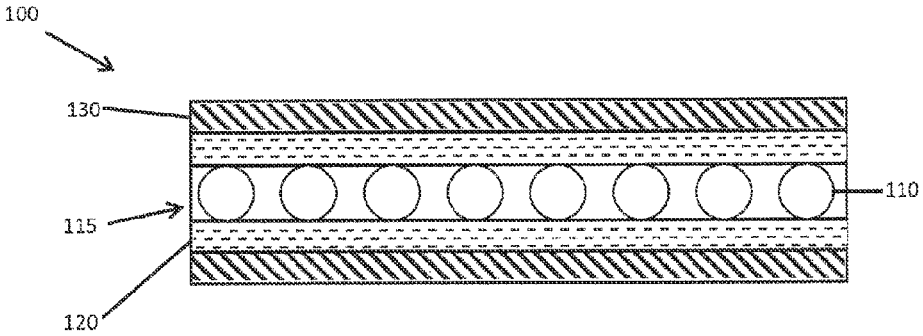
FIGS. 8 and 9 are illustrations showing the construction and composition of first and second generally planar yarn assemblies used in the nonwoven press felt base fabrics of the present invention.

FIG. 8 shows details of a particularly preferred construction of the first fabric structure 100 presented in FIG. 7. As shown, the yarns 110 of the first array 115 are "sandwiched" between two layers of a hot melt adhesive web material 120 to retain them in a desired position. SpunFab™ copolyamide thermoplastic adhesive, identified by part number FA1200-090-040 and available from Spunfab, Ltd. of Cuyahoga Falls, Ohio has been found to be suitable for this purpose; other adhesives, including thermoset adhesives, may also be satisfactory. The preferred thermoplastic adhesive is heat activated and has a first melting temperature; it provides a bond sufficient to bind the yarns 110 of the first array 115 in their desired positions to a fine fibrous scrim 130.

The first array 115 and adhesive web 120 are then sandwiched between two layers of an elastic carrier layer, preferably in the form of a fine fibrous scrim 130, which is significantly more robust than the adhesive web 120; the fibrous scrim 130 provides cohesive strength to the array 115 to which the yarns 110 are bonded by the adhesive web 120, and this strength is sufficient to enable subsequent processing of the array during assembly. One particularly preferred scrim is Cerex PA-6/6 (polyamide 6-6) scrim, part no. G31-25-96 available from CEREX Advanced Fabrics, Inc. of Cantonment, Fla.; other scrim materials may also be suitable. The Cerex PA-6/6 scrim is a fibrous web of continuous fine PA-6/6 fibers having a dtex in the range of from 1 to 10 that are thermally bonded together to provide a drapable textile-like fabric and is available from the manufacturer in rolls about 1 m in width. The product is available in a range of air permeabilities from about 100 cfm (~1,560 m3/m2/hr) and may range as high as 2000 cfm (~31,200 m3/m2/hr), or more. The Cerex scrim is also available from the manufacturer in various weights of from 0.30 to 4.0 osy (ounces per square yard) and has a tensile strength in this weight range of from about 5 lb/in up to about 160 lb/in. (as determined by ASTM D5034), making it suitable to increase the strength and robustness of the first array for handling. One particularly preferred fibrous scrim has a weight of about 0.50 osy (16.9 g/m2) (as determined by ASTM D3776) and has an air permeability of about 1,516 CFM (23,400 m3/m2/hr). Scrim materials having weights greater than this may be useful in the production of press felts with relatively lower air permeability.

This fibrous scrim 130 appears to provide a further and somewhat surprising benefit in that the small component fibers appear to act similarly to a fine batt material and assist to enhance the dewatering effect of the press felts of the invention. The fine fibers are effective in wicking moisture from the batt into the interior of the felt where it is subsequently removed by vacuum after transporting water from the sheet. In addition to providing structural support to the first and second fabric structures, the fibrous scrim thus appears to enhance the dewatering capability of the press felts of the present invention.

The yarns 110 of the first array 115 are preferably monofilaments comprised of a polyamide polymer. Alternatively, cabled monofilaments could be used as some or all of the yarns 110 of the first array. Polyamide-6 (also known as nylon 6 or PA-6) is presently preferred for this purpose due to its "toughness", resistance to degradation due to environmental effects, and tensile strength, although other polyamide materials may prove suitable. The yarns 110 of the first array 115 will be oriented, following assembly of the first fabric structure 100 in the spiral winding process, at a small angle of from about 1° to about 5° to the intended MD of the completed press felt and will thus provide the yarn loops forming the seam region of the completed press felt. The number of MD yarns per unit width (yarn density) in the first fabric structure 100 is preferably different from that in the generally planar yarn assembly second, and will be in the range of from 15-40 yarns/inch (5.9 to 15.7 yarns/cm); as shown in FIG. 8, the yarn density in the first preferred embodiment of the array 115 of the first fabric structure 100 is 18 yarns/in. (7.1/cm). The yarn density of the first fabric structure 100 is preferably selected to present an "open" structure to the PS surface of the press felt to maximize water removal, permeability and void volume in the completed press felt. Further, as these yarns 110 will provide the eventual seam loops in the seam region of the completed press felt, they must be spaced apart sufficiently to allow the two sets of loops from the opposing ends of the fabric to be capable of being intermeshed without any undue distortion. The yarns 110 of the first fabric structure 100 also provide the necessary seam tensile strength to the assembled press felt and must therefore be sufficiently robust so as to withstand the various mechanical and environmental forces to which they may be exposed during use. Thus, the yarn type, size and spacing are all important features of the first fabric structure and must be chosen with these considerations in mind.

For this reason, the yarns 110 of the first fabric structure 100 are arranged as a first planar yarn array, and are preferably of a different size to those in the generally planar yarn assembly that forms the second fabric structure 200 and are preferably larger; monofilaments having a preferably circular cross-sectional shape and a diameter of from about 0.3-0.6 mm are suitable; circular cross-section monofilaments having a diameter of 0.5 mm are presently particularly preferred for this purpose.

The adhesive web 120, first array 115 and fine fibrous scrim 130 are assembled in the manner shown in FIG. 7 and then heated under pressure in a continuous hot lamination process to a temperature sufficient to melt the adhesive web 120 so as to bond the yarns 110 in the first array 115 together to the fibrous scrim material 130 and thus retain them at the desired orientation and yarn density. In a preferred assembly, this heating temperature is in the range of from about 220° F. to about 280° F. (104° C.-138° C.). Selection of appropriate heating temperature sufficient to melt the adhesive web 120 will be dependent on the speed by which the fabric structure is moved through the lamination process. During and following the lamination process, a portion of the adhesive web 120 melts and effectively dissipates into the fabric structure, leaving behind the first array 115 and fibrous scrim material 130 as the first fabric structure 100. This assembled and laminated first fabric structure 100 will preferably have an air permeability that is in the range of from about 200 to about 400 CFM (3120 to 6240 m3/m2/hr) when a fibrous scrim 130 having a weight of about 0.50 osy (16.9 g/m2) and air permeability of about 1,516 CFM (23,400 m3/m2/hr) is used in combination with a yarn density of about 18 yarns/in. (7.1/cm) and diameter of 0.5 mm for the yarns 110. An alternative first fabric structure could be an extruded or molded arrangement with the MD filaments/yarns embedded into the structure, such as a layer of pure polyurethane.

Figure 9:
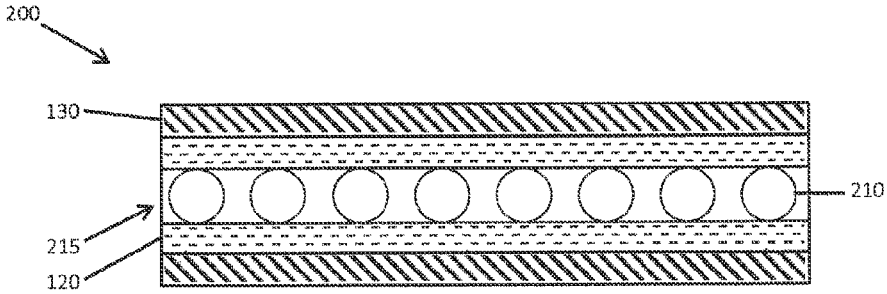
Figure 12A:
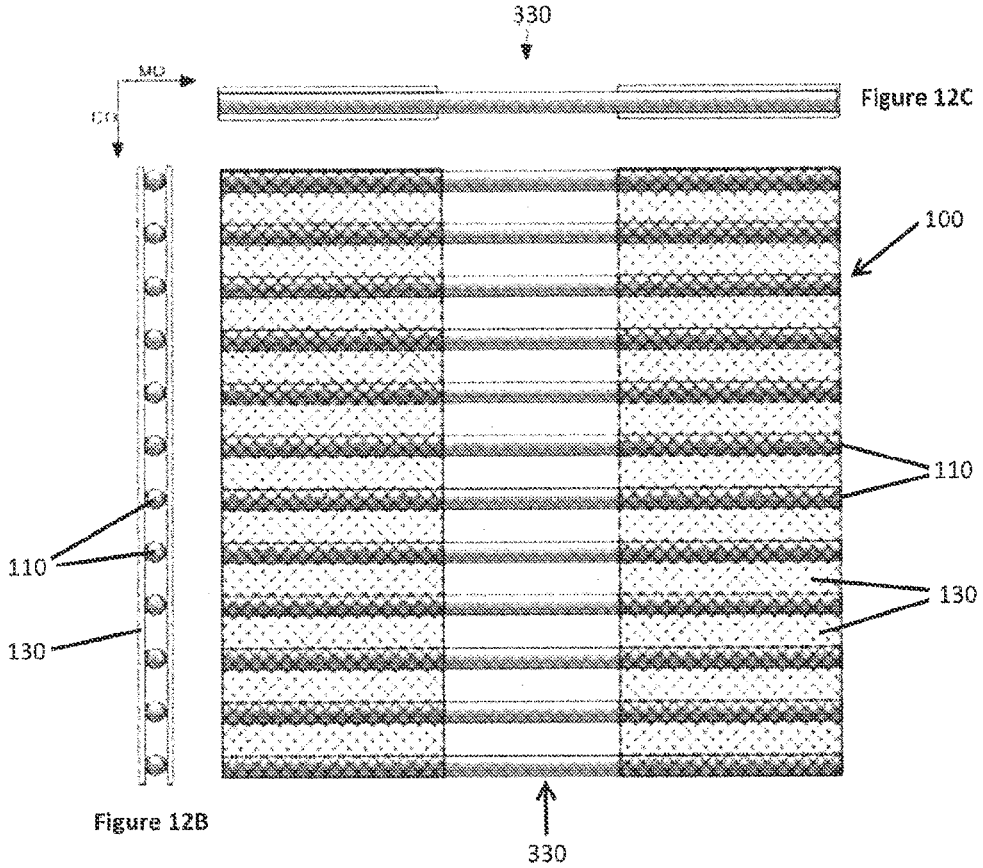

FIG. 9 shows details of a particularly preferred construction of the generally planar yarn assembly 200, which is similar to that presented in FIG. 7, except that the yarns 210 in the array 215 are preferably smaller in diameter or size and arranged at higher density than those in the first array 115 of fabric structure 100. As shown, the yarns 210 of the second array 215 are "sandwiched" between two layers of a hot melt adhesive web 120 to retain them in a desired position. As in FIG. 6, SpunFab™ copolyamide thermoplastic adhesive, part number FA1200-090-040 available from Spunfab, Ltd. of Cuyahoga Falls, Ohio and which is heat activated is particularly preferred, although other adhesives may prove satisfactory. The second array 215 and adhesive web 120 are then sandwiched between two layers of an elastic carrier material, preferably in the form of the fine fibrous scrim material 130 which provides cohesive strength to the array and adhesive; Cerex PA-6/6 scrim, part no. G31-25-96 available from CEREX Advanced Fabrics, Inc. described above is particularly preferred for this purpose, although other fabric scrims may prove suitable.

The yarns 210 of the second array 215 used in the yarn assembly 200 are preferably also monofilaments, but could also be cabled or other multicomponent yarns, or combinations of monofilaments, cabled and/or multifilament yarns, and are preferably comprised of a polyamide polymer; for this application, yarns comprised of polyamide-6/10 (or PA-6/10, or nylon 6/10) are presently preferred due to their dimensional stability when exposed to varying moisture levels, although other types of polyamide yarns may prove suitable. The yarns 210 of the second array 215 will be oriented, following assembly of the yarn assembly 200 with the first 100 as described in detail below, in the intended CD of the completed press felt. The yarn density of the second array 215 will preferably be higher than that in the first array 115 and will preferably be in the range of from about 21 to 30 yarns/in. (8.3 to 11.8 yarns/cm) when selected in conjunction with the yarn density of the first array 115 so that the chosen value meets this criterion. As shown in the construction presented in FIG. 9, in a particularly preferred arrangement of the second array 215 for use with the preferred arrangement of the first array 115, the yarn density is 24 yarns/in (9.45 yarns/cm). Alternatively, the yarns 210 of the second array 215 may be provided at a density equal to, but not less than, the yarn density of the first array 115, i.e. 15 to 40 yarns/inch (5.9 to 15.7 yarns/cm). Also as shown, the size or diameter of the yarns 210 in the second array 215 is smaller than that of the yarns 110 in the first array 115; monofilaments having a circular cross-sectional shape and a diameter of about 0.4 mm are presently preferred for this purpose when used in combination with larger yarns 110 in the first fabric structure 100. It would also be possible to use cabled monofilaments as the yarns 210 of the second array 215. If this is done, then the component monofilaments should have a diameter, d, in the range of 0.1 to 0.3 mm, and may be cabled in one of a d×2×2, d×2×3 or d×3×3 arrangements. The effective diameter of these cabled yarns (i.e.: the outside diameter of the cabled assembly) is preferably selected so as to be less than or equal to the diameter of the single monofilament yarns 110 in the first array 115. The yarns 210 of the yarn assembly 200, when assembled with the first fabric structure 100 in the completed press felt, provide a CD oriented support surface to the fabric and paper conveyed; they thus should be provided as comparatively smaller yarns (in relation to those in the first fabric structure 100) and arranged at a higher density than those in the first structure 100. Although monofilaments can be used satisfactorily, cabled or other multicomponent yarns will provide improved batt anchorage, which may be necessary in certain applications. Also, certain applications may dictate that the yarn density and size in the second array 215 be equal to that in the first array 115. An alternative yarn assembly 200 could be an extruded or molded arrangement with the CD filaments/yarns embedded into the structure, such as a layer of pure polyurethane. The yarn assembly 200 can be assembled from multiple sections, as discussed below in connection with FIGS. 19A-20B.

FIG. 10A is a planar view of the first fabric structure 100 shown schematically in FIGS. 7 and 8. In FIG. 10A, the first yarn array 115 is comprised of a plurality of single monofilaments 110 having a desired size and a selected regular spacing which are bonded together between two layers of the fine fibrous scrim material 130 using two layers of a hot melt adhesive web (not shown) to retain them in a desired position on the scrim. The first array 115, adhesive web and fibrous scrim 130 are bonded together in a hot lamination process employing heat and pressure as previously described to form the first fabric structure 100 which, following preparation, is sufficiently robust and cohesive so as to allow subsequent handling and assembly. As previously mentioned, the fine fibers in the fibrous scrim 130 also provide a type of precursor batt material which may later offer benefits to the assembled press felt with respect to improved dewatering and batt anchorage. FIGS. 10B and 10C show a CD cross-section and a side view taken along one of the MD monofilaments 110, respectively.

Figure 13:
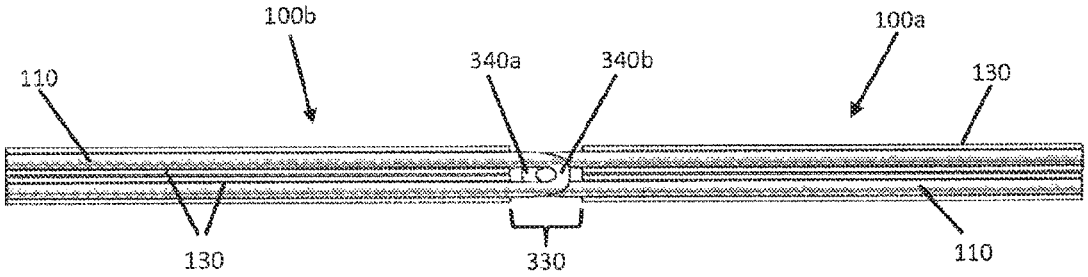
FIG. 13 shows a cross-section of the seam regions at the two folded ends of the base fabric of FIG. 12A-C where they have been intermeshed together at the exposed and folded MD yarns of the first fabric structure which now form a series of loops across the fabric structure.
Figure 14:
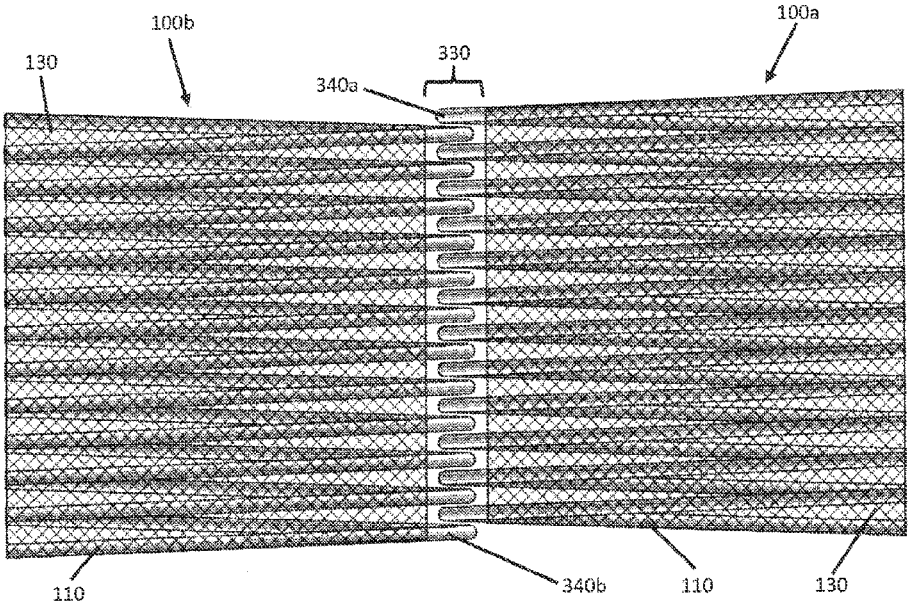
FIG. 14 is a planar view of the yarns and remaining second scrim at the seam region in the first fabric structure shown in FIGS. 12A-C and 13.

A continuous length of the first fabric structure 100 is provided as described above and is then spirally wound and assembled in a known manner as shown in FIGS. 1-3 and 11, to provide a continuous tube 300 that is open in the center area 310. As shown in FIG. 11, the yarns of the first fabric structure 100 are oriented left to right across the Figure in the longitudinal or lengthwise direction of the spirals and are canted at a small angle to the intended MD of the finished fabric. Yarn loops 340*a*, 340*b* (see FIG. 13) formed by the yarns 110 of the first fabric structure 100 at the opposing first and second fold regions 320*a*, 320*b* of the continuous tube 300 are then freed from the fibrous scrim materials using a rotary brush 350 or similar device which may be mounted so as to translate across the fold regions 320*a*, 320*b* of the tube 300. Removal of scrim material 130 between the yarns 110 in the fold regions 320*a*, 320*b* creates an open area 330 at the fold regions 320*a*, 320*b* in the spirally wound first fabric structure 100 as shown in planar view at FIG. 12A, and in FIGS. 12B and 12C which are similar to FIGS. 10B and 10C. When the tube 300 is collapsed as shown in FIG. 11, the freed yarns 110 in the area 330 form loops 340*a*, 340*b* at the opposing fold regions 320*a*, 320*b* as shown in FIG. 13 which will be used to provide a seam in the assembled press felt. The yarn size and density in the first fabric structure 100 is selected so that these loops 340*a*, 340*b* can be intermeshed in the manner shown to form the seam region of the eventual fabric. The appearance of the intermeshed yarn loops 340*a*, 340*b* from the opposing fold regions 320*a*, 320*b* of the spirally wound and collapsed continuous tube 300 are shown in planar view in FIG. 14; fibrous scrim 130 has been cleared from the open area 330 at the fold regions where the yarn loops 340*a*, 340*b* are brought together and intermeshed.

Figure 15:
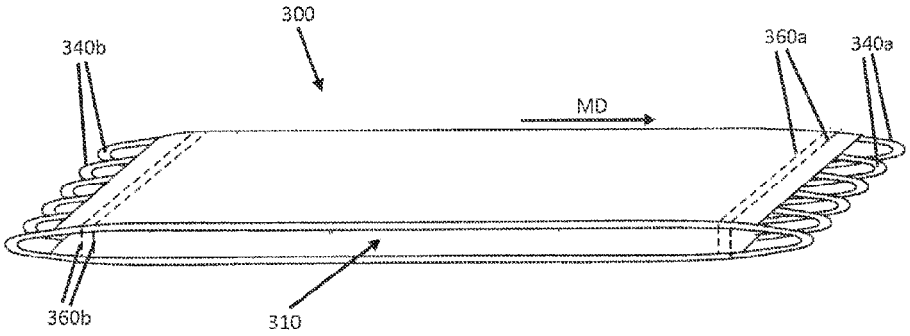
FIG. 15 is a schematic representation of a perspective view of the double layer structure of FIGS. 11 to 14 in which the spirally wound continuous tube base fabric formed of the first fabric structure has been opened in the center area to accept a generally planar yarn assembly; the dotted lines indicate where stitching may occur to join the first fabric structure and yarn assembly.
Figure 16:
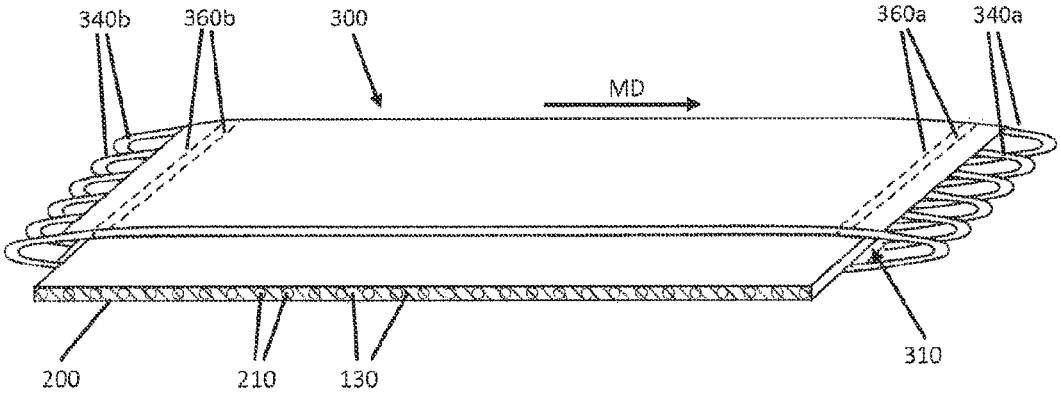
FIG. 16 is a perspective view of the first fabric structure of FIG. 15 in which a generally planar yarn assembly (second fabric structure) is partially inserted into the open, flattened central area of the tube now formed by the first fabric structure in a first embodiment of the invention.
Figure 21:
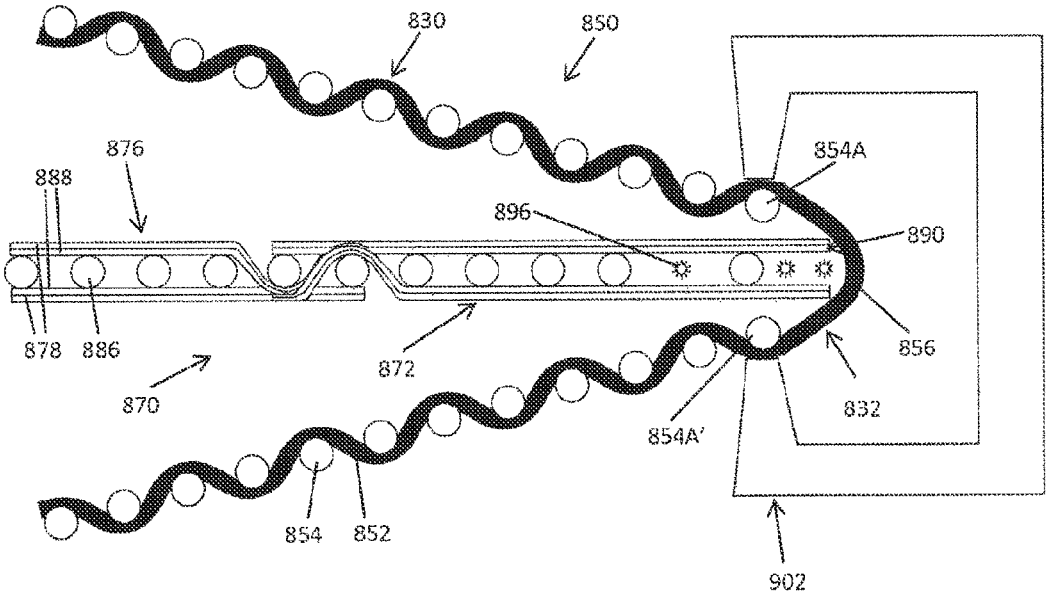
FIG. 21 is schematic cross-sectional illustration showing the insertion of an MD end of a first panel of the yarn assembly of FIGS. 20A and 20B into the fold region of a continuous loop of base fabric material where it is fixed into position using the clamping device illustrated.

FIG. 15 is similar to FIG. 11 but shows the freed MD yarn loops 340*a*, 340*b* exposed following the brushing process diagrammatically illustrated in FIG. 11. At this point, the flattened tube 300 is ready for the generally planar yarn assembly that forms the second fabric structure 200 to be inserted into the open area 310 inside the collapsed tube 300; this is illustrated in FIG. 16. Following insertion of second fabric structure 200 in the manner described in detail below, one or more rows of stitches as indicated by dotted lines 360*a*, 360*b* are provided to the collapsed tube 300 interior to and adjacent the yarn loops 340*a*, 340*b* in the seam region of the tube. The stitching is preferably carried out in a similar manner as discussed in connection with FIGS. 21 and 22, below. This stitching will stabilize the newly formed loops 340*a*, 340*b* and prevent them from migrating or rolling out of plane during subsequent processing, and retain the second fabric structure 200 in its desired position inside open area 310 of collapsed tube 300. It is important that the loops 340*a*, 340*b* be stabilized at this point in the assembly process as it will be very difficult to align them at a later stage.

As shown in FIG. 16, the continuous tube 300 is collapsed and laid flat prior to insertion of the generally planar yarn assembly or second fabric structure 200, and the interior length of the flattened tube is measured. A sufficient length of the yarn assembly 200 is prepared, with its length being from 1% to 10% less than the interior length of the flattened tube. The generally planar yarn assembly 200, preferably assembled as discussed below in connection with FIGS. 19A-20B, is inserted into the open central area 310 interior to the flattened continuous tube 300 prior to stitching the assembly as shown at 360*a*, 360*b*. The generally planar yarn assembly 200 exhibits a degree of stretch in a direction transverse to the yarn orientation, and so may be extended as necessary to fill area 310 from end to end. Once inserted, one end of the continuous length of second fabric structure 200 is stitched in position at one end of the tube as shown by the dotted lines 360*a*, and then stretched to reach the opposite end of the tube interior 310*a* where it is again stitched in position as shown by dotted lines 360*b*. The end can be held in position via a clamp, such as 902 in FIG. 21, so that the end touches the interior edge of the MD yarn loops at the fold. The jaw of the clamp 902 is then closed to secure the first end of the yarn assembly 200 in this orientation between the two layers of first fabric structure 100. As the clamp is closed over the fold, the MD yarn loops move away from the outside edge of the first end by a small distance creating a uniform opening or channel between the first end of the yarn assembly 200 and the interior of the MD yarn loops. This opening eventually becomes the pintle channel in the press felt 300. The first end of the yarn assembly 200 is then stitched (for example with stitching 360*a*, 360*b* shown in FIG. 16), tacked, bonded or otherwise secured in place within the first fold region. Once the first end of the yarn assembly 200 is secured to the first fabric structure 100, the remainder other end is brought towards the opposite fold region within the prepared continuous loops of first fabric structure 100. The generally planar yarn assembly 200 is preferably prepared to a length that is from 90% to 99% of the length of the first fabric structure 100 into which it is installed. The generally planar yarn assembly 200 is then uniformly tensioned to bring it towards the second opposing fold region. The yarn assembly 200 is then pulled into the fold region so that the second end is brought into contact with the MD yarn loops. The applied tension to the yarn assembly 200 stretches it by between 1% and 10% of its relaxed length, ensuring that any creases, folds or other deviations from generally planar are removed. The second end of the generally planar yarn assembly 200 is then clamped in position in a manner similar to that used at the opposite end as previously described to provide a second open channel whose size is equal to the first. The fold region and second end of the yarn assembly 200 are then stitched, for example with stitches 360*b*, tacked, bonded or otherwise secured in position. The second fabric structure 200 ideally fills the entire space 310 and is held in place by the rows of stitching 360*a*, 360*b* which also serve to stabilize loops 340*a*, 340*b*. The continuous tube 300, now filled with the planar assembly of bonded panels of second fabric structure 200, is then joined together using the yarn loops 340*a*, 340*b* at the opposing fold regions 320*a*, 320*b* in the manner shown schematically in FIG. 17.

Figure 17:
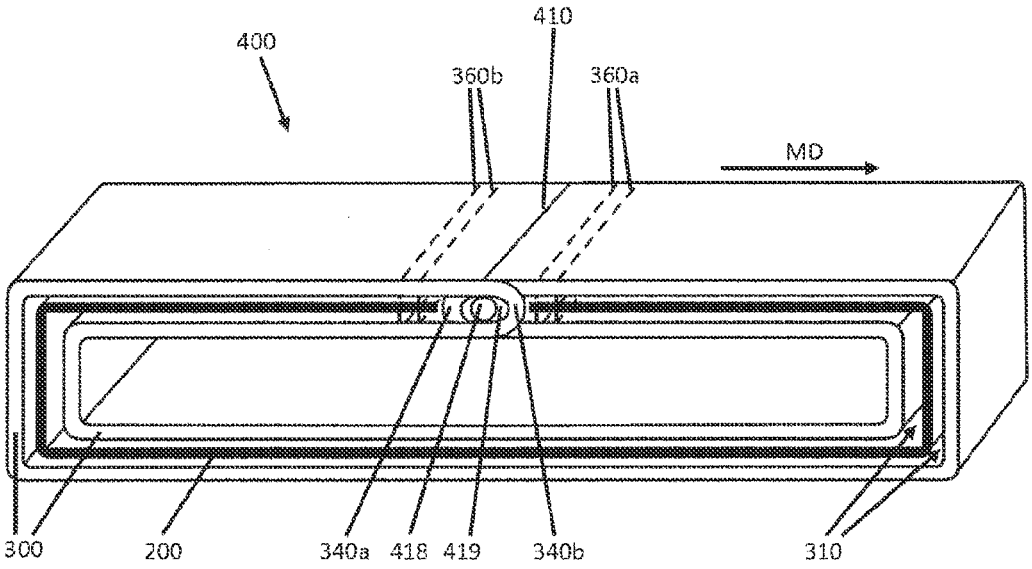
FIG. 17 is a perspective view of the assembled first fabric structure and generally planar yarn assembly as arranged according to a first embodiment of the press felt base fabric of the invention following insertion of the yarn assembly as shown in FIG. 16.

FIG. 17 is a schematic representation of a press felt 400 according to a first embodiment of the invention and is a perspective view taken across a lateral edge along the MD. As shown, press felt 400 includes two layers of spirally wound continuous tube 300 formed from successive turns of a first fabric structure 100 arranged in the manner described in relation to FIGS. 11 through 15 and joined one to the next along their lengthwise edges. Yarn loops 340*a*, 340*b* formed from the yarns 110 of first fabric structure 100 and are oriented in the length or MD direction of the press felt 400 when in use. The yarn loops 340*a*, 340*b* are held orthogonal to the plane of the press felt 400 and, when brought together and intermeshed provide open channel 419 through which pintle 418 may be inserted to close the opposing ends of press felt 400 when installed on the machine for which it is intended.

The second fabric structure 200, which is preferably assembled from a number of panels that have been joined edgewise one to the next, is located into tube 300 as a continuous generally planar yarn assembly 200 as described in relation to FIG. 16 above. The rows of dashed lines 360*a*, 360*b* indicate the location where the first and second fabric structures 100, 200 are stitched together prior to needling and further processing so as to retain them in alignment, and stabilize loops 340*a*, 340*b*. As assembled in press felt 400, the yarns 210 of second fabric structure 200 are oriented in the CD perpendicularly to the yarns 110 in the plane of first fabric structure 100 of continuous tube 300. The component yarns 210 are preferably equal to, or smaller in diameter than the component yarns 110 and may be provided at the same or a higher density, and as either single or cabled monofilaments. One or more layers of a fibrous batt material is needled into the assembly of the second fabric structure and continuous tube; the batt is cut at seam region 410 to provide access to the yarn loops 340*a*, 340*b* so that they may be intermeshed during installation of press felt 400. A pintle such as 418 is located in the channel 419 formed by intermeshed loops 340*a*, 340*b* so as to join the press felt 400.

As can be seen in FIG. 17, press felt 400 is a three-layer construction, consisting of two layers of continuous tube 300 consisting of first fabric structure 100 arranged between which (such as at 310) is located one layer of second fabric structure 200. The press felt 400 further includes a seam formed by yarn loops 340*a*, 340*b* through which a pintle such as 418 may be passed allowing the press felt 400 to be joined on the machine or which it is intended. The press felt 400 is thus a wholly nonwoven, multiaxial construction including a seam.

In the embodiments, one or more layers of a fibrous batt material (not shown) are needled into the three-layer assembly using known techniques common to the manufacture of press felts. The fibrous batt material is typically a selected mixture of polyamide fibers such as is known in the art; it is possible that a portion of these fibers may be bi-component in nature and include an adhesive component which, during subsequent fabric processing, melts to provide improved surface fiber retention and smoothness to the resulting fabric.

Figure 18B:
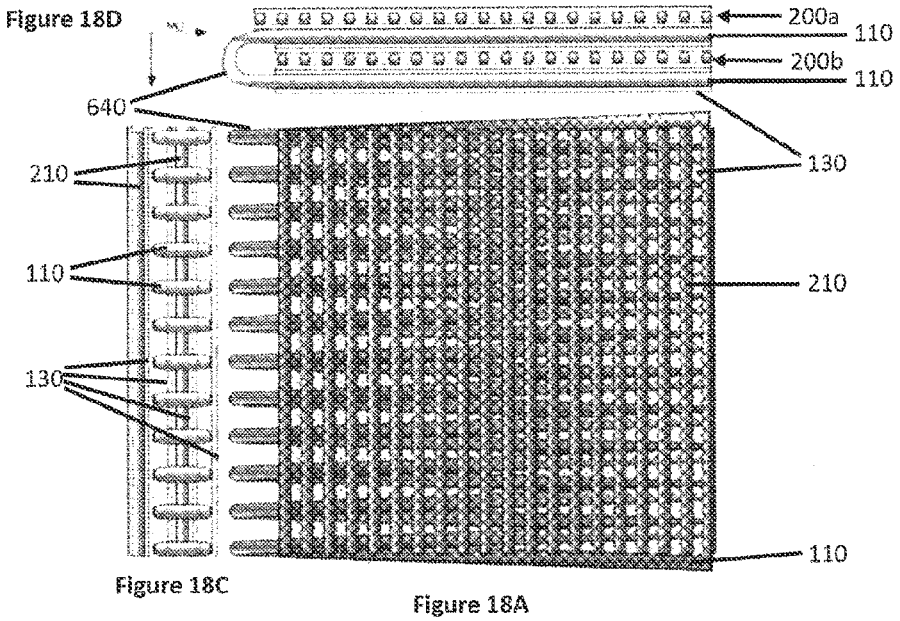
FIG. 18B is a schematic perspective view of the same arrangement.
Figure 18B:
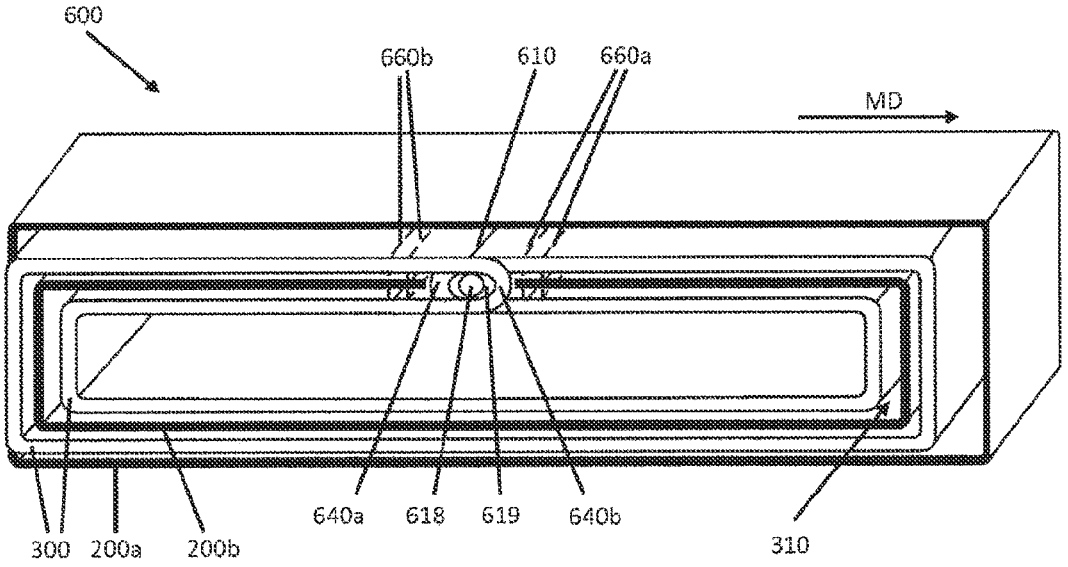

FIGS. 18A-18D present a second embodiment of a nonwoven press felt 600 according to the present invention in which a first continuous layer or length of second fabric structure 200*a* is located, or "socked", over one exterior surface of continuous tube 300, and a second continuous layer of second fabric structure 200*b* is located interior to the tube 300 (in open area 310) in the manner described in relation to FIG. 15. FIG. 18A provides detail of the second fabric structures 200*a*, 200*b* and the yarns 110 of the first fabric structure in this configuration.

As shown in FIGS. 18A, 18C, and 18D, the base fabric of press felt 600 shown schematically in FIG. 18B includes first yarns 110 arranged in two layers. The yarns 110 form loops 640 at the left side of FIG. 18A where they loop back at a fold region. A first layer of second fabric structure 200*a* including yarns 210 is located on top of the yarns 110 of the first fabric structure, and a second layer of second fabric structure 200*b* is located between the two layers of yarns 110 of the first fabric structure provided as continuous tube 300. The yarns 210 of the second fabric structures 200*a*, 200*b* are arranged perpendicularly to the MD oriented yarns 110 in the first fabric structure CD. Both structures 100 and 200 include a fine fibrous scrim 130 between which the yarns of each are arranged.

FIG. 18B provides a schematic illustration of a press felt constructed using the arrangement of first and second fabric structures shown in FIG. 18A. The press felt 600 includes two layers of second fabric structures 200*a* and 200*b*. Second fabric structure 200*a* is provided as a continuous loop and is located around the exterior of tube 300, while second fabric structure 200*b* is located in open area 310 of continuous tube 300 in the manner described in relation to FIGS. 16 and 17. Seam region 610 is formed by intermeshing loops 640*a* and 640*b* from the fold regions 320*a*, 320*b* of continuous tube 300 in the manner previously described in relation to the embodiment shown in FIG. 16. The loops 640*a*, 640*b* are stabilized by providing one or more rows of stitching such as 660*a*, 660*b* in a manner similar to that shown in FIG. 15 following insertion of fabric structure 200*b* so that the loops are retained orthogonal to the plane of the press felt 600 and, when brought together and intermeshed provide open channel 619 through which pintle 618 may be inserted to close the press felt 600 into an endless loop on the machine for which it is intended. Stitching 660*a*, 660*b* passes through second fabric structure 200*b* retaining it in desired position inside continuous tube 300 and adjacent seam loops 640*a*, 640*b*. Additional stitching (not shown) may be required to retain the continuous loop of second fabric structure 200*a* in its desired location surrounding continuous tube 300. One or more layers of a fibrous batt material are then needled into the assembly of the second fabric structure 200*a*, 200*b* and continuous tube 300 comprising first fabric structure 100; the batt and second fabric structure 200*a* are cut at seam region 610 to free or clear the yarn loops 640*a*, 640*b* so that they may be intermeshed and joined by a pintle 618 during installation of press felt 600 as previously described.

Thus, the press felt 600 is a four-layer construction, consisting of two layers of first fabric structure 100 arranged as a continuous tube 300 and exterior to which is located one layer of second fabric structure such as 200*a*, and interior to which is located one layer of second fabric structure such as 200*b*. The yarns 110, 210 of each fabric structure 100, 200 are provided in arrays of mutually parallel yarns and are oriented perpendicularly to one another in the assembly. The press felt 600 further includes a seam allowing it to be joined on the machine or which it is intended. The press felt 600 which is a second embodiment of the invention, is thus a wholly nonwoven, multiaxial construction including a seam. It would of course be possible to use a woven structure to form continuous tube 300. Such a structure would include both MD and CD oriented yarns; it would be necessary to remove a portion of the CD yarns adjacent the fold regions so as to expose yarn loops such as 640*a*, 640*b*. Such a woven structure could be flat or endless woven in the manner previously described, or it could be a spirally wound woven fabric. Regardless of how the first fabric structure 100 is formed, the seam region is prepared as described in relation to FIG. 16 using the clamping arrangement described in relation to FIG. 21.

In the embodiments discussed above, the yarn loops 340 and 640 formed at each of the seam regions are comprised of continuous yarns 110 from the first fabric structure 100, which are oriented longitudinally in the MD of the press felt.

As previously discussed, it is necessary to remove a portion of the fibrous scrim material 130 from the fold regions 320*a*, 320*b* of the continuous tube 300 of first fabric structure 100 so that yarn loops 340, 640 in the seam region are free and clear of this scrim material; these loops are subsequently retained in alignment by one or more rows of stitching 340 located immediately behind and adjacent them and by locating a jig or similar stabilizing means into them to maintain this alignment through further processing of the base fabric. This device is utilized to fold and hold the loops into position for stitching, with or without the CD base being inserted into the loop area. A separate mechanical component would clamp, insert and position the CD insert base. Following assembly of one or more layers of the generally planar yarn assembly that forms the second fabric structure 200 with continuous tube 300 in the manner previously described, and after a needling process, it is necessary to again free these yarn loops 340, 640 of excess batt fiber so that the seam region can accommodate a pintle, such as 418, 618 or similar retaining means that is passed through the loops as the finished fabric is joined on the machine for which it is intended. The batt fiber in this fold region is typically cut and brushed back to form a flap of nonwoven material which is laid back over and reattached at the seam region to minimize any discontinuity there. This process does not always result in an entirely acceptable flap and it is frequently necessary to insert special yarns, commonly referred to as "stuffer yarns", adjacent the seam region to enable secure attachment of the batt.

This and other issues can be addressed in the fabrics according to a further embodiment of the present invention by inserting multifilament yarns having a higher cross-sectional surface area than either monofilament or cabled yarns into the first and last panels of the generally planar yarn assembly that forms the second fabric construction 200 located adjacent the seam region 310, 410, 610.

A preferred construction of the second fabric panel 200 for use in connection with the above embodiments of the invention as well as for use in connection with woven first fabric structures is described in detail below.

Referring to FIGS. 22-25, a press felt 850 the assembly of the press felt according to the invention is shown. The press felt 850 is formed using a base fabric 830 having an MD length and CD width including at least MD oriented yarns 852 and arranged in two superimposed layers joined by the MD oriented yarns 852 at CD oriented fold regions 832, 834 at each of two opposing ends 836, 838 thereof. The base fabric 830 may correspond to the first fabric construction 100 above, or can be a woven or non-woven fabric. The illustrated embodiment is a woven fabric with a plain weave. The MD oriented yarns 852 form loops 856, 858 at the fold regions 832, 834 to define a uniform channel 860 extending the CD width of the press felt 850. The base fabric 830 can be of the known prior art type shown in FIGS. 1 to 6, and may be an endless woven fabric, a modified endless woven fabric, a flat woven fabric, two layers of nonwoven yarn arrays such as discussed above, a multiaxial structure formed from woven or nonwoven fabric strips (see FIGS. 1 and 2). In each case, at least a set of the generally parallel MD oriented yarns 852 is provided, and in at least the woven fabrics CD oriented yarns 854 are also provided. The base fabric 830 is either collapsed/flattened (when endless) or folded in two layers (when flat) to provide the desired length of two superimposed layers with two opposing CD fold regions 832, 834. The loops 856, 858 of MD yarns 852 that will eventually form seam regions at the opposing fold regions 832, 834 of the now double layer structure are now exposed.

A generally planar yarn assembly 870, which is a particularly preferred version of the second fabric construction 200 above, preferably is located on the interior of the base fabric 830; an additional assembly 870 could also be located on an exterior thereof. The construction of a preferred embodiment of the generally planar yarn assembly 870 is shown in FIGS. 19A, 19B, 20A, 20B. The yarn assembly 870 includes an array of mutually parallel and regularly spaced polymeric yarns 886. These yarns 886 are bonded to an elastic carrier material 878 in a single layer. The yarns 886 are preferably single or cabled monofilaments, and are preferably comprised of a polymer selected from a polyamide or a polyurethane. The spacing of the yarns 886 can be adjusted in order to adjust a void volume of the press felt 850. The elastic carrier material 878 is comprised of a stretchable material in the form of one of: an elastomeric membrane, a permeable film, an elastic nonwoven mesh or web, a woven assembly formed of elastomeric yarns such as polyurethane yarns, a knitted material, or, preferably, a nonwoven loosely bonded fibrous scrim formed of continuous fibers. The elastic carrier material 878 is capable of stretching, under uniformly applied tension, by an amount equal to at least 1%, and as much as 10% or more of its relaxed length without rupture. Here, the preferred elastic carrier material 878 is the Cerex PA-6/6 scrim (part no. G31-25-96) available from CEREX Advanced Fabrics, Inc. of Cantonment, Fla.; however, other materials, such as an extruded mesh or film having similar elastic properties may prove suitable, for example, such as Conwed extruded webbing (urethane), perforated urethane film, Albany Apertec perforated urethane webbing, Voith Spectra urethane membrane, or warp and weft knit polyamide. This is preferably connected to the upper and lower sides of the yarns 886 using adhesive layers 888, which are preferably a heat activated or hot melt adhesive. It is noted that the spacing of the yarns 886 can also be adjusted, at least in part, by the stretching of the elastic carrier material 878.

Figure 19A:
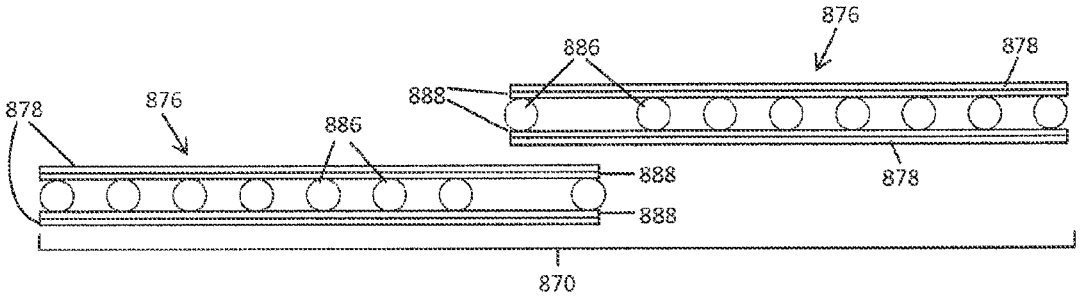
FIG. 19A is a cross-section through the MD edge of a generally planar yarn assembly including yarn panels formed of an elastic carrier layer and regularly spaced monofilament yarns laminated to the elastic carrier layer. The spacing of the yarns at the edge regions of each of the two separate yarn panels has been adjusted to allow for the formation of a lap join (FIG. 19B) allowing two adjacent yarn panels to be joined together during formation of the generally planar yarn assembly.
Figure 19B:
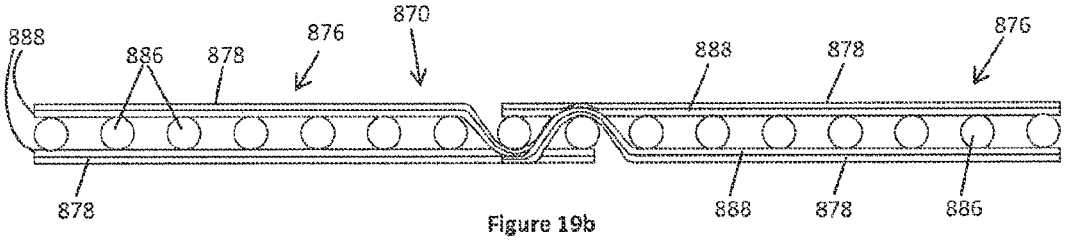

The yarn assembly 870 is preferably assembled in a modular manner using a plurality of yarn panels 872, 874, 876 which can be assembled to achieve a desired length L. The yarn assembly 870 preferably includes a first outside yarn panel 872, at least one interior yarn panel 876, and a second outside yarn panel 874. Interior yarn panels 876 are bonded together in side by side relation as shown in FIGS. 19A and 19B. When installed, the interior yarn panels 876 are oriented so that all of the yarns 886 are directed in the CD direction in the press felt base fabric 830. The yarn panels 876 are prepared so that the spacing of the yarns 886 is maintained, for example by removing one yarn 886 that is spaced in from an MD edge of the yarn panel 876, so that when two of the panels 876 are bonded together, the yarn spacing is maintained. The yarn panels 876 are bonded together with a bonded connection, which can be formed by an ultrasonic weld.

Figure 20A:
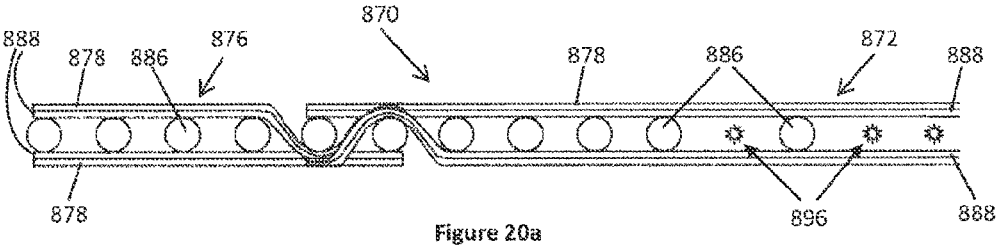
FIG. 20A is a cross-sectional representation of an outside yarn panel for use as a first or second outside yarn panel of the generally planar yarn assembly which are to be located adjacent the seam region in the interior or exterior of the base fabric. The first and second outside yarn panels include a high surface contact area material component at each of their outside ends which is oriented parallel to the remaining yarns of the yarn assembly.
Figure 20B:
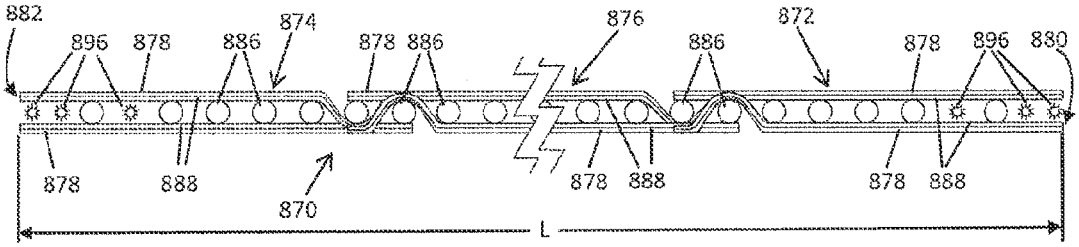
FIG. 20B shows a cross section through a full length of the generally planar yarn assembly, including first and second outside yarn panels as well as interior yarn panels, ready for insertion into a continuous loop of base fabric material. Each panel in the assembly is joined to an adjacent panel using a lap join which is closed by bonding, in particular ultrasonic welding. Each panel is formed of a plurality of regularly spaced yarns bonded, for example, in a lamination process, to an elastic carrier layer which is a generally planar sheet of a somewhat elastic, stretchable material.

The first and second outside yarn panels 872, 874 include a high surface area material (HSCAM) 896, such as a multicomponent yarn, at an exterior MD edge 880, 882 as shown in FIGS. 20A and 20B. The HSCAM 896 can be a strip of nonwoven fibrous material, at least one multifilament yarn or cabled yarn, or the like and is oriented parallel to the component yarns 886 of the yarn array. Some examples are: 1) Invista 1000 denier yarn, 140 filaments per yarn, 7 denier per filament. 2) PrismaFiber 2800 denier 80 filaments per yarn, 35 denier per filament. Multiple yarns per seam side can be used. The MD edges 880, 882 extend to a position that will be located adjacent to the fold regions 832, 834 of the base fabric 830, the HSCAM 896 have a spacing that is the same as the array of mutually parallel and regularly spaced polymeric yarns 886 of the interior yarn panel(s) 876, and may replace some or all of the regularly spaced polymeric yarns 886. Sufficient numbers of the HSCAM yarns may be located so as to extend as far as 2.5 cm (1 in.) from the seam area, or could form a greater portion of the interior yarns. The first and second outside yarn panels 872, 874 are bonded, preferably by ultrasonic welding, to the MD edges of the interior yarn panel(s) 876 such that the yarn assembly 870 initially extends in a relaxed state over about 90% to 99% of the full flattened interior MD length of the two superimposed layers of woven or nonwoven base fabric material 30 from first fold region 832 to the second fold region 834, and in a width equal to the CD width of the base fabric 830. The completed length L of the yarn assembly 870 shown in FIG. 22, which extends between the two ends 890, 890 defined by the exterior MD edges 880, 882 of the first and second outside yarn panels 872, 874, is then rolled or otherwise manipulated in preparation for installation in the prepared continuous loop of base fabric material 830.

Figure 25:
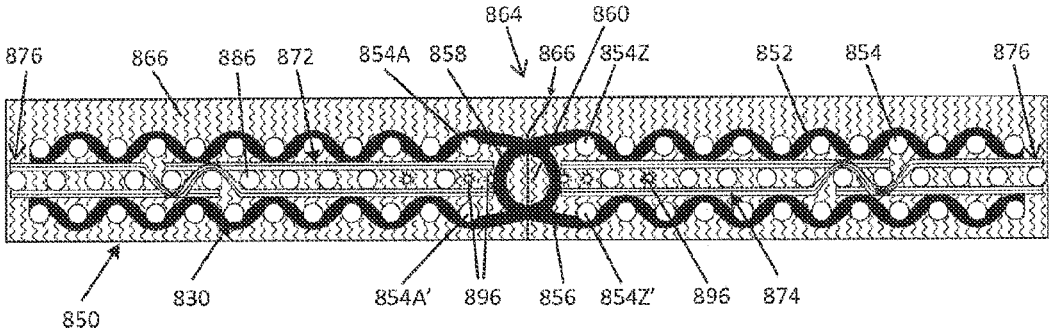
FIG. 25 is a cross-sectional illustration of the press felt base fabric presented in FIG. 22 following needling of one or more layers of a fibrous batt material to the base fabric; the cut line for the batt flap is also indicated.
Figure 26:
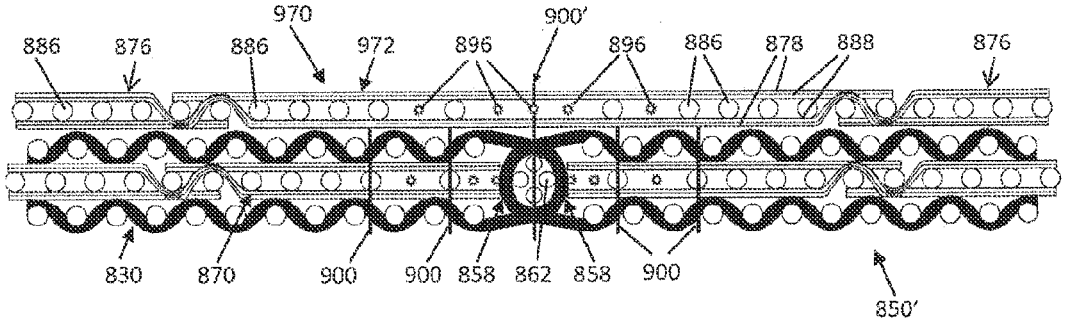
FIG. 26 is an illustration showing a first alternate embodiment of the invention in which a second layer of yarn panel material is attached to one exterior surface of press felt base fabric. The illustration shows one yarn assembly located interior to the continuous tube in the manner described in relation to FIG. 23, and a second, similar layer located similarly to the first, on an exterior surface of the base fabric. Both yarn assemblies are illustrated as they would be prepared at the first and last panels located adjacent the seam.
Figure 27:
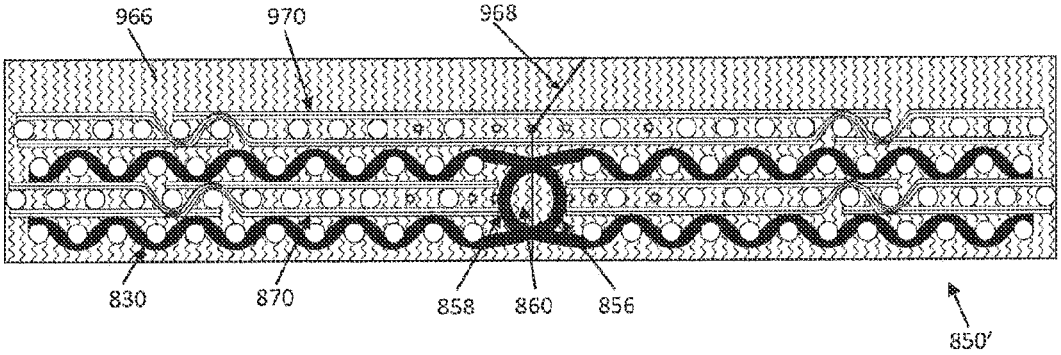
FIG. 27 is an illustration showing the press felt base fabric and first and last yarn panels of the two yarn assemblies in the manner described in relation to FIG. 25 following a needling process.

The prepared yarn assembly 870 is preferably located interior to the base fabric 830 as shown in FIGS. 21-25. An additional yarn assembly may also be superimposed on an exterior surface of the continuous double layer loop of base fabric material 830 including an interior yarn assembly, for example as shown in FIGS. 26 and 27.

Figure 22:
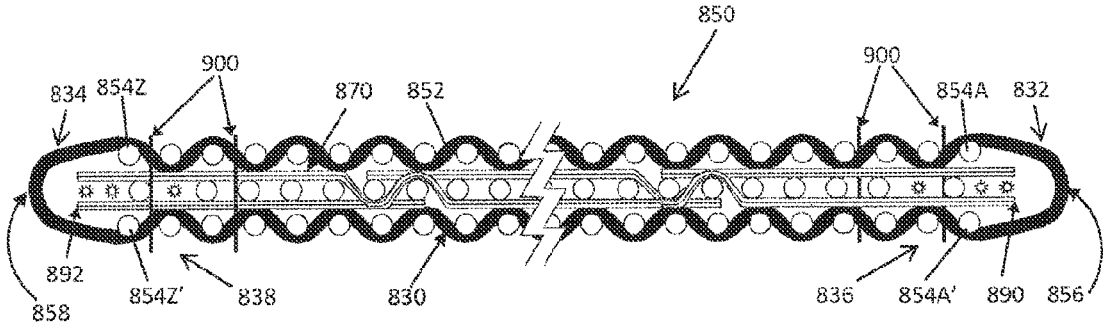
FIG. 22 is an illustration showing a cross-section through the base fabric and yarn panels following their assembly in the manner described in relation to FIG. 21 after insertion into the interior of the two fold regions of the continuous loop of base fabric.

The prepared yarn assembly is preferably installed interior to the continuous loop of base fabric material in the following manner. Each of the two fold regions of the base fabric 830 is securely fixed such as between opposing surfaces of a jaw or similar clamp 902 shown in FIG. 21. The continuous loop of base fabric 830 is then "tented" to provide access to the interior region between the two superimposed layers. The yarn assembly 870, including first and last panels 872, 874 prepared in the manner previously described, and provided in a length preferably equal to about 90% to 99% of the flattened interior length of the two superimposed layers, is brought into the interior region of the continuous loop and is partially unwound (or manipulated) to free a first outside edge of the first outside yarn panel 872. A support is preferably provided so as to support the first panel so that it can be unwound while supported. The clamp 902 at the first fold region 832 is loosened and a portion of the outside edge of the first panel 872 including the HSCAM 896 is slid into the fold so that its outer edge 890 touches the interior edge of the MD yarn loops 856 at the fold. The jaw of the clamp 902 is then closed to secure the first yarn panel 872 in this orientation between the two layers of base fabric 830. As the clamp 902 is closed over the fold, the MD yarn loops 856 move away from the outside edge 890 of the first panel 872 and the HSCAM 896 by a small distance creating a uniform opening or channel 860, shown in FIG. 25, between the HSCAM 896 and the interior of the MD yarn loops 856. This opening between the interior of the MD yarn loops 896 and the edge 890 of the first panel 872 where the HSCAM 896 is fixed in position is now a uniformly wide and free channel that eventually becomes the pintle channel 860 in the press felt 850. Prior to closing the jaw, the position of the HSCAM 896 relative to the interior of the MD yarn loops 856 is checked to ensure that it is in contact with the interior surface of loops 856. While this position is preferred, other positioning could be utilized. As the jaw of the clamp 902 is closed, the MD yarn loops 856 all move "forward" by the same amount away from the interior of the press felt 850, thus providing that the orientation and position of the HSCAM 896 preferably does not deviate from an orientation parallel to the interior edges of the first seam loops 856 by more than the diameter of the joining pin or pintle 862 that is eventually inserted through the open channel 860 in the loops 856 to close the seam 864. The first end 890 of the yarn assembly 870, including the HSCAM 896, is then stitched (for example with stitching 900 shown in FIGS. 22-24), tacked, bonded or otherwise secured in place within the first fold region 832 of the base fabric 830. Preferably, the generally planar yarn assembly 870 is anchored to the base fabric material 830 adjacent to the loops 856 with the HSCAM 896 extending at least partially into the loops, as shown in FIG. 22. For a woven base fabric, preferably the MD end 890 extends past a last CD yarn 854A, 854A' of each of the superimposed layers adjacent to the loops 856, as also shown in FIG. 22. As shown, preferably the yarn assembly 870 is anchored to the base fabric 30 at least in an area adjacent to the MD ends 836, 838 so that the exterior MD edge 890 extends a predetermined uniform distance into or over the loops. Preferably, the deviation is no more than 1 mm and is preferably less.

Once the first outside yarn panel 872 is secured to the base fabric 830, the remainder of the yarn assembly 870 is then unwound, or otherwise freed, and the second outside yarn panel 874 including the second outside edge 892 with the HSCAM 896 is brought towards the second fold region 834 within the prepared continuous loops 858 of base fabric material 830. As previously noted, the yarn assembly 870 is preferably prepared to a length L that is from 90% to 99% of the flattened interior length of the base fabric 830 into which it is installed. Once fully unwound, the yarn assembly 870 is uniformly tensioned to bring it towards the second opposing fold region 834. See FIG. 22 for the desired positioning. The yarn assembly 870 is then pulled into the fold region 834 so that the HSCAM 896 at the exterior MD edge 882 of the second outside yarn panel 874, which defines the end 892 of the yarn assembly 870, is brought into contact with the MD yarn loops 858. The applied tension to the yarn assembly 870 stretches it by between 1% and 10% of its relaxed length, ensuring that any creases, folds or other deviations from generally planar are removed. The HSCAM 896 and outside edge 892 of the second outside yarn panel 874 are then clamped in position in a manner similar to that used at the opposite end as previously described to provide a second open channel whose size is equal to the first. The fold region 834 and second outside yarn panel 874 including the HSCAM 896 are then stitched, for example with stitches 900, tacked, bonded or otherwise secured in position such that the orientation of the HSCAM 896 generally does not deviate from parallel to the interior of the MD yarn seam loops 858 at the second fold region 834, preferably by more than the diameter of the joining pin or pintle, and preferably by no more than 1 mm. For a woven base fabric, preferably the MD end 892 extends past a last CD yarn 854Z, 854Z' of each of the superimposed layers adjacent to the loops 858, as also shown in FIG. 22.

Figure 23:
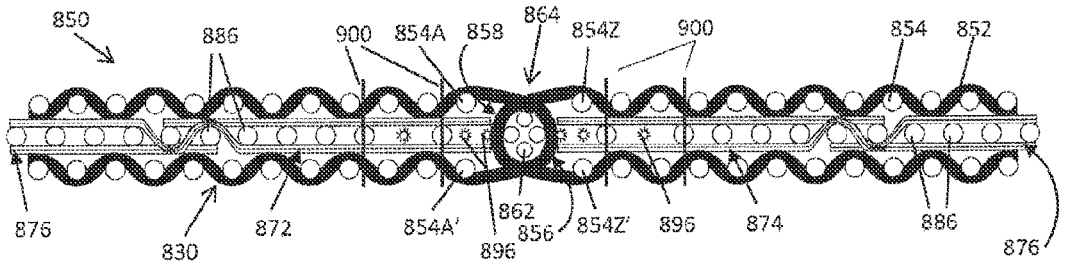
FIG. 23 is an illustration of a portion of a partially assembled press felt base fabric in one embodiment of the invention including first and last panels of the yarn assembly illustrated in FIGS. 20A and 20B which have been inserted into the continuous loop of base fabric in the manner shown in FIG. 21 so as to be located and stitched in position in the manner shown in FIG. 22 so as to be located adjacent the interior of the seam loops. The opposing ends of the press felt have been joined with a temporary pintle prior to needling.
Figure 24:
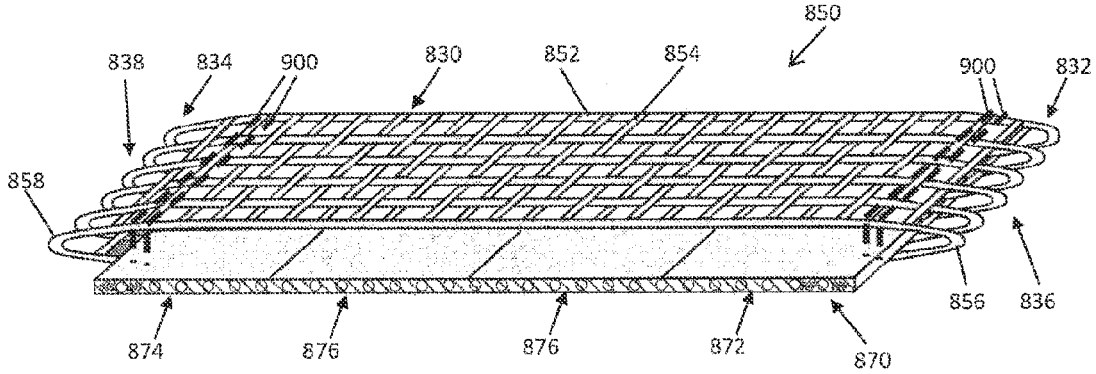
FIG. 24 is an illustration showing the press felt base fabric with the generally planar yarn assembly installed in an interior of the base fabric and stitched at both MD ends.

The resulting assembly, now comprising the two continuous and superimposed layers of a woven or nonwoven base fabric material 830 jointed at the two fold regions 832, 834 by MD oriented yarn loops 856, 858 and between which layers is located the generally planar yarn assembly 870 including a HSCAM 896 at each end 890, 892 is joined by a pintle 862 to form a fabric tube that is ready for needling with a batt 866 to form the press felt 850 and any subsequent fabric processing. The pintle 862 is preferably formed from a bundle of non-twisted monofilaments (a multi-filament bundle of 3, 4, 5, or 6 filaments) that is preferably permanently installed once the assembly is installed on a papermaking machine. Here, as shown in FIGS. 23 and 25, the MD ends 890, 892 of the generally planar yarn assembly 870 preferably contact an MD outer surface of the loops 856, 858 from the opposing end 836, 838 of the base fabric 830. Because the ends 890, 892 are fixed in position, even upon stretching of the seam area, the MD ends 890, 892 preferably remain within 1 mm of the MD outer surfaces of the loops 856, 858 from the opposing ends 836, 838 of the base fabric 830, as shown in FIG. 25.

As shown in FIG. 25, after needling the batt 866, a batt flap cut 868 is made to allow the seam 864 of the press felt 850 to be disconnected to allow later installation of the press felt 850 on papermaking equipment.

The HSCAM 896 serve to provide anchorage for the batt fibers needled into the press felt base fabric 830 in precisely the location where they are most needed. Overall seam uniformity is thus improved in comparison to prior art seams in multiaxial fabrics, and opportunity for batt delamination at this area is diminished. Additionally, the novel method of installing the HSCAM so that it is precisely & reliably positioned provides a uniform pintle channel through which the pintle is installed thus improving ease of installation and minimizing discontinuity at the seam region The resulting press felt 850 now includes three layers of yarns, one from each of the upper and lower surfaces of the double layer base fabric 830, and one from the yarn assembly 870. The component yarns 886 of the yarn assembly 870 are preferably oriented cross-wise perpendicularly to the MD yarns 852 of the base fabric 830 and are regularly and evenly spaced along the interior of this structure from the first to the second fold regions 832, 834. This provides for increased void volume due to the yarn assembly inly including CD yarns 886.

As previously mentioned, the polymer from which the component yarns 852, 854 of the base fabrics 830 of the invention is made is preferably a polyamide, in particular polyamide-6, but other polyamides and copolymers thereof may prove suitable. It has also been found that yarn panels assembled from a plurality of laminated polyurethane monofilament yarn arrays may provide certain advantages due to their elastic compression properties; these may offer improvements in vibration resistance without detracting from the surface properties of base fabric. Additionally, polyurethane yarns will provide for better compression and rebound when appropriately spaced so as to leave lateral voids between each that allow the yarn to expand in width without producing vertical compression resistance. This, as well as increased void volume, can be quantified with various compression tests.

A fourth layer of yarns in the form of a second yarn array 970 may be attached to one of the two exterior surfaces, if desired; its yarns being oriented in the CD and the assembly being positioned on an exterior surface of the tube formed by the base fabric 830. The second yarn array 970 is similarly constructed to the yarn assembly 870, and for example, as shown in FIGS. 26 and 27, can be attached to the top exterior surface, but could also be attached to the bottom exterior surface. Here, the press felt 850' is similar to the press felt 850 above, and includes the base fabric 830 and the yarn assembly 870 located interior to the base fabric 830. The external yarn assembly 970 is formed using the interior yarn panels 876, and a single seam area yarn panel 972 that overlays the seam area and forms the yarn assembly into a tube. The seam area yarn panel 972 is similar to the outside yarn panels in that it includes the HSCAM 896 in an area adjacent to and over the seam area. The yarn assembly 970 is formed and located over the base fabric 830 after the interiorly located yarn assembly 870 has been installed, and is held in position by stitching 900' prior to needling the batt 966 into the fabric assembly to form the press felt 850', as shown in FIG. 27. Here the batt flap cut 968 is shown which extends through the exterior yarn assembly layer 970.

In the preferred embodiments, the yarn assembly 870, 970 is comprised of at least one, and typically multiple, interior yarn panels 876. A yarn panel 872, 874, 876, 972 will usually have a width of from about 0.5 m to about 1.0 m, but may be more or less than this range. If more than one interior yarn panel 876 is used, each is joined edgewise to the next preferably by a small lap joint, and each is then bonded to the next at a joint, preferably by ultrasonic welding. Each interior yarn panel 876 is comprised of an array of mutually parallel polymeric single or cabled monofilament yarns 886; preferably, they are single monofilaments but cabled monofilaments may provide certain additional benefits (such as improved batt fiber anchorage or press felt compressibility); each yarn 886 is bonded to an elastic carrier material 878, preferably using a hot melt adhesive layer 888 that is laminated under pressure.

The yarn assembly 870, 970 is prepared from at least one, and preferably a plurality of interior yarn panels 876 as well as outside yarn panels 872, 874 to a dimension equal to the CD width of the base fabric 30 into which it will be located and a length L (FIG. 20B) sufficient to cover from 90% to 99% of the MD length of the continuous loop of base fabric material 830 (i.e.: it fully spans the CD width of the tube or loop, but is shorter than its MD length by from 1-10%). The yarn panels 872, 874, 876, 972 comprising the preferred embodiment of the yarn assembly 870, 970 preferably include an array of single or cabled monofilaments 886 as well as the HSCAM 896 in the areas noted, each of which are laminated under heat and pressure using a hot melt adhesive sheet or film 888 to the elastic carrier material 878.

The elastic carrier material 878 is preferably a somewhat open, air permeable sheet or material. It must be capable of elastic deformation in at least one dimension by from 1% to at least 10% of its initial, relaxed length. It must be capable of accepting an adhesive bond such as would be formed by a hot melt adhesive. Although a nonwoven fibrous scrim such as described above has proven to provide satisfactory results, other permeable and elastically deformable materials may prove suitable.

The single or cabled monofilaments 886 are preferably comprised of a polyamide polymer; for this application, monofilaments comprised of polyamide-6/10 (or PA-6/10, or nylon 6/10) are preferred, however other polyamides and copolymers thereof may prove suitable. Monofilaments comprised of a polyurethane polymer may also be used. The monofilaments of each yarn panel 872, 874, 876, 972 are regularly arranged at a spacing of from about 21 to 30 yarns/in. (8.3 to 11.8 yarns/cm) depending on whether they are single or cabled yarns, and depending on the end use requirements of the press felt 850 (e.g.: void volume, resiliency, compressibility, water handling and dewatering characteristics).

The yarn assembly 870, 970 is formed by overlapping the yarn panels 872, 874, 876, 972 with a lap joint formed adjacent longitudinal portions of each yarn panel 872, 874, 876, 972 and then bonding together one yarn panel to the next at this area; ultrasonic welding is preferred for this purpose, but other bonding means may prove suitable. The lap joint is formed by adjusting the spacing of some of the longitudinal yarns at the outer edges 890, 892 of the yarn panels 872, 874, 876, 972 so that there is an unchanged, constant yarn-to-yarn spacing at the overlap join in comparison to that in remainder of the panel. One yarn panel may be inverted relative to the next so that the changed yarn spacing at the edge of one can mesh with that of the adjacent panel so that the yarn spacing at this area is unchanged in comparison to the remainder of the panel width.

As discussed above and shown in FIGS. 20A and 20B, the first and second outside yarn panels 872, 874 of the yarn assembly 870 are further modified in comparison to the others by replacing a portion of the monofilament or cabled monofilament component yarns 886 at the panel edges that will be located adjacent the CD oriented fold regions with HSCAM 896 such as multifilament yarns (e.g. continuous multifilament or staple spun multifilament yarns) or other HSCAM type materials. This is most advantageously done by preparing a continuous length of the outside panel material ahead of assembly and separately from those used for the interior panels 876. Each of the two longitudinal edges of the first and last panels is constructed slightly differently from those used in the body as follows.

The first edge of a first outside panel 872 is arranged as described above so as to allow for a lap join to bond/weld this first edge of the first outside yarn panel 872 to the adjacent edge of the interior yarn panel 876 of the yarn assembly 870 which has already been prepared. The second outside edge 880, which will be located adjacent to the seam region 832 has a portion of the component yarns 886 replaced with HSCAM 896, such as multifilament yarns, which provide a larger surface area than monofilaments. As few as one, or as many as 10 multifilament yarns or HSCAM 896 can be bonded to the elastic carrier material 878 in the manner described above so that they are located at the second outside edges 880, 882 of the outside yarn panels 872, 874. These multifilament yarns or HSCAM 896 can be arranged in succession (one after the other), or they may be alternated with cabled or single monofilaments, or in any suitable arrangement and order; the main requirement is that they be laid parallel to the remaining yarns 886 of the panel 872, 874 and at the same or similar spacing. These HSCAM 896 are used later during the assembly to increase batt adhesion adjacent the seam region when the fabric is finished as they will provide more sites for batt fiber anchorage than will single or cabled monofilaments. The first and last yarn panels 872, 874 may be the same, or a different width, to the remainder of the interior panels 876 used in the yarn assembly 870.

To assemble the first and last yarn panels 872, 874 with the remainder of the panels 876 in the yarn assembly 870, the first edge of the first outside yarn panel 872 is bonded by ultrasonic welding or other means to the adjacent interior panel 876 of the yarn assembly 870 such that the yarn spacing/density of the monofilaments at the lap join remains constant with that of the panel to which it is bonded (see FIGS. 20A, 20B).

A nonwoven yarn assembly 870 such as has been described and which is preferably interior to the double layer base fabric 830, and optionally on one exterior surface, offers numerous benefits to the press felts into which they are introduced, whether the base fabrics 830 are woven or nonwoven:

Elimination of interference patterns and improved surface uniformity—if the yarn assembly 870 is located interior to the double layer base fabric 830, and optionally on an exterior surface, it will effectively mask any interference patterns that may result from the overlay of two identical weave structures. Also, a nonwoven CD yarn array located interior to a base fabric tube will prevent "nesting" of the component yarns from the two opposing surfaces when the press felt is under compression, thus improving surface uniformity of the resulting press felt 850. A similar effect is provided by locating the yarn assembly 970 on one or both exterior surfaces of the base fabric 830 in conjunction with a yarn assembly 870 located in the interior as it will provide a flat layer of material which will prevent the nesting effect from being expressed on the exterior of the base. This is because the component yarns of the assembly are laid flat in the CD (perpendicularly to the MD yarns of the base fabric) and are bonded by lamination onto a flat carrier material.

Void volume—in the past, the common method used to increase the void volume of press felts was to increase the size/diameter of the component yarns of the base fabric. A problem with this approach, however, is that the larger yarns also occupy part of the void space they are intended to provide, so only small gains are actually realized. In the press felts according to the present invention, void volume is comparatively easily adjusted by inserting a nonwoven yarn array 870, 970 either inside or outside the spirally wound tube of base fabric material 830. Adjustments to yarn size and spacing can be easily made prior to and during lamination; use of the resulting nonwoven yarn assembly 870, 970 in this manner appears to provide a more open base fabric structure with higher (or lower) void volume as desired. Adjustments to the yarn spacing allow for larger yarns to provide the desired increase in void volume.

Improved batt anchorage—As seam formation traditionally requires single monofilaments, the strength of batt anchorage adjacent the seam is less than desirable due to the relatively low surface area of these monofilaments which provide for comparatively fewer points of anchorage for the batt fibers needled into the structure. To overcome this problem in prior art press felt base fabrics, multifilament stuffer yarns are often inserted into the base fabric. A problem with this approach is that the stuffer yarns "wander" and are not uniformly placed; insertion of the stuffers particularly in multiaxial press felt base fabric constructions is a time consuming and laborious task. In the press felt 850, 850' of the present invention, the pre-assembled yarn array end panels 872, 874 of the yarn assembly 870 include multifilament yarns or HSCAM 896 which are positioned as desired during assembly of the array so as to be uniformly straight and which can now be located adjacent the seam region due to the assembly method described; their comparatively higher surface area increases the number of locations available for batt anchorage in comparison to single monofilaments. In addition, a yarn assembly including cabled monofilaments as at least a portion of its component yarns will also increase batt anchorage locations across the entire width and length of the fabric in comparison to all-single monofilament constructions, particularly when inserted interior to the spirally wound tube of base fabric.

Improved water handling and nip dewatering—prior art press felts including a base fabric formed from single monofilament yarns are relatively incompressible and open. Use of a nonwoven yarn assembly in the locations previously described will improve compressibility characteristics of the resulting press felt 850, 850' resulting in improvements to nip dewatering; this performance may be enhanced through the use of polyurethane yarns as components of the yarn assembly.

Reduced Stringing—prior art multiaxial press felts were frequently cut beside the seam area in order to clear out batt material from the seam loops, and provide a batt flap to cover the seam region. Such fabrics often carried an additional layer of woven base fabric material located to one of the planar surfaces of the spirally wound tube. During seam formation, this region is usually cut through to form and prepare the seam; a flap of material is often prepared at this location which flap includes a portion of the component yarns from the additional layer of base material. Although every effort is made to needle the flap area tightly, abrasive wear along the flap edge will often cause a portion of the MD yarns to fray out and become loosened over time. This is referred to as "stringing" and results in seam marking of the sheet carried by the press felt. In the press felt base fabrics of the present invention, an additional layer of the generally planar yarn assembly material is preferably located to the interior of the tube of spirally wound material strip. Because this layer is now located interior to press felt base fabric and behind the seam loops, it cannot string as occurred in the prior art.

Fabric Assembly Process:

The base fabric 830 including at least lengthwise (MD) yarns 852 is prepared in the form of a double layer continuous textile tube of desired length and width; preferably, it is formed by spirally winding a woven or nonwoven material strip as shown in FIGS. 1 and 2. However, it could be flat woven or continuously woven fabric as shown in FIGS. 5 and 6. The base fabric 830 is laid flat and fold regions 832, 834 are formed at each opposed end (see FIG. 22) where a seam 864 (see FIGS. 23 and 25) will be installed. Any excess material adjacent the folds is removed to expose the MD yarns 852 which now form open loops 856, 858.

A planar yarn assembly 870 preferably formed of a plurality of laminated yarn panels 872, 874, 876 each including an array of mutually parallel yarns 886 (preferably polymeric monofilaments, either single or cabled) is prepared.

The component yarns 886 of each yarn panel 872, 874, 876 are arranged so as to be mutually parallel at a desired spacing. The panels 872, 874, 876 are laminated under heat and pressure in a continuous process to an adhesive web 888 which is in turn bonded to a, preferably nonwoven, elastic carrier material 878 such as a fibrous scrim, nonwoven elastic web or lattice, or planar elastic film, to provide the yarn panels 872, 874, 876. See FIGS. 19A and 19B. The elastic carrier material 878 imparts stretch to the resulting yarn panels 872, 874, 876 so that it is stretchable in a direction essentially perpendicular to the orientation of the yarns 886 of the array in the plane of the panel.

A plurality of lengths of yarn panels 872, 874, 876 are prepared, each of which is cut to a length equal to the CD width of the base fabric 830 into (or onto) which it is to be placed; a sufficient number of such lengths of panel material are provided so that, when joined and bonded edge to edge, they will have a length L that essentially extends the flattened interior length of the base fabric tube 830 from one fold region 832 to the opposite fold region 834 in a single layer (less 1% to 10% of that overall length) to provide the planar yarn assembly 870; as the panels of the module are somewhat elastic, the yarn assembly 870 can be stretched to fit the interior width. The yarns 886 in the lateral edges of each panel 872, 874, 876 are arranged such that a lap joint can be formed in which the yarn spacing is continuous.

The exterior edges 890, 892 of the first and second outside yarn panels 872, 874 of the planar yarn assembly 870 which will be located adjacent the fold regions 832, 834 of the base fabric 830 are provided with special HSCAM material 896 such as multicomponent yarns or other high surface area materials which are bonded into these laminate panels in the desired outboard positions. See FIG. 20A. A continuous roll of material structured and arranged in the desired manner may be prepared separately to that used in the body of the fabric (in Step 4 above). The width of these exterior panels 872, 874 may be the same, or different from that of the other yarn panels. One of these exterior yarn panels 872, 874 is bonded to each end of the yarn assembly 870. See FIG. 20B.

The now completed planar yarn assembly 870, including the HSCAM 896 in the first and second outside yarn panels 872, 874, is carefully and precisely located in position inside (or on an exterior surface) of the base fabric. See FIGS. 21 and 22; for convenience, the yarn assembly may be rolled onto a roller, pole or similar device. The first exterior yarn panel 872 of the assembly is brought into contact with the interior surfaces of the MD yarn loops 856 at the fold region 832 (or if located on an exterior surface is positioned so that its outside yarn is located at least partially over the seam loops). This edge 890 is then clamped in position so that the outside yarn(s) are in the desired position adjacent the MD yarn loops 856 of the base fabric 830, and then stitched, for example with stitches 900, sewn or otherwise bonded to hold it securely.

Once the first exterior yarn panel 872 is securely clamped and attached, the remainder of the yarn assembly 870 is then extended towards the opposite fold region 834 of the base fabric 830. The MD length L of the yarn assembly 870 is from 1% to 10% less than the overall flattened interior length of the base fabric 830. The yarn assembly 870 is uniformly tensioned across its CD width so as to stretch the elastic carrier 878 (with the laminated yarns 886 attached to it) by an amount sufficient to bring the outside yarn of the second outside yarn panel 874 into position adjacent the seam loops 858. Once located as desired, the panel 874 is clamped in position, and then sewn, stitched, stapled or otherwise securely located in position as with the first outside yarn panel 872.

The assembled fabric 850 thus includes the double layer woven or nonwoven base fabric 830 inside or upon and inside of which is located at least one nonwoven yarn assembly 870 whose first and second outside panels are located adjacent the seam loops 856, 858 of the base fabric 830 and which include HSCAM 896, preferably in the form of multifilaments. More than one multifilament may be located at the outside edges 890, 892 of each of the first and second outside yarn panels. Each yarn panel 872, 874, 876 of the yarn assembly is joined edge to edge with that adjacent to it; a lap joint is preferred which is sealed by preferably ultrasonic welding. The resulting base fabric is then needled to attach at least one layer of batt 866 material to at least one of the two opposing surfaces. Excess batt fibers are cleared from the MD yarns forming the seam loops 856, 858 at each opposed fabric end 836, 838. The resulting press felt 850 is then conditioned using techniques known in the art so as to stabilize the entire assembly; following this, the press felt 850 is ready for installation on the machine for which it is intended.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

The invention claimed is:

1. A seamed press felt comprising a base fabric material having an MD length and CD width including at least MD oriented yarns and arranged in two superimposed layers joined by the MD oriented yarns at CD oriented fold regions at each of two opposing ends thereof, the MD oriented yarns forming uniform loops at the fold regions to define a channel extending the CD width of the press felt, a generally planar yarn assembly including an array of mutually parallel and regularly spaced polymeric yarns, each bonded to an elastic carrier material that is extensible by at least 1% of a relaxed length thereof, the generally planar yarn assembly being located interior to the two superimposed layers of base fabric and is oriented such that the yarns of the array are oriented in the CD of the press felt, a high surface contact area material is bonded to the elastic carrier material at at least both exterior MD edges thereof that form the MD ends of the yarn assembly that are located adjacent to the loops formed of the MD oriented yarns at the fold regions and extend in the CD width direction, each of the MD ends is oriented parallel to the loops of the MD oriented yarns and is anchored in a fixed position adjacent to the loops at each of the fold regions, and a pintle extending through the channel defined by intermeshing the loops from the two opposing ends to form a seam.

2. The press felt according to claim 1, wherein in the fixed position, the MD ends of the generally planar yarn assembly contact an MD outer surface of the loops from the opposing end of the base fabric.

3. The press felt according to claim 1, wherein in the fixed position, the MD ends remain within 1 mm of the MD outer surfaces of the loops from the opposing end of the base fabric.

4. The press felt according to claim 1, wherein the generally planar yarn assembly is anchored to the base fabric material adjacent to the loops and the high surface contact area material extends at least partially into the loops.

5. The press felt according to claim 1, wherein the base fabric is woven, and the MD ends extend past a last CD yarn of each of the superimposed layers adjacent to the loops.

6. The press felt according to claim 1, wherein the generally planar yarn assembly is anchored to the base fabric material at least in an area adjacent to the MD ends so that the exterior MD edge with the attached high surface contact area material extends a predetermined uniform distance into-the loops.

7. The press felt according to claim 1, wherein the high surface contact area material does not move from the fixed position by a distance greater than a width of the pintle that extends through the loops of MD oriented yarns.

8. The press felt according to claim 1, wherein the base fabric is woven.

9. The press felt according to claim 1, wherein the base fabric is non-woven.

10. The press felt according to claim 1, wherein the base fabric is one of an endless woven, modified endless woven, flat woven, multiaxial construction, or a non-woven construction.

11. The press felt according to claim 1, wherein the elastic carrier layer is one of: an elastomeric membrane, a permeable film, an elastic nonwoven mesh, a woven assembly of elastomeric yarns, a knitted material, or a nonwoven loosely bonded fibrous scrim.

12. The press felt according to claim 1, wherein the elastic carrier layer is a nonwoven loosely bonded fibrous scrim.

13. The fabric according to claim 12, wherein the nonwoven loosely bonded fibrous scrim material is a thermally bonded nonwoven open network of continuous polyamide fibers having a dtex in the range of 1 to 10, and an air permeability of from about 100 cfm (~1560 $m^3/m^2/hr$) to about 2,000 cfm (~31,000 $m^3/m^2/hr$) or more.

14. The press felt according to claim 1, wherein the high surface contact area material is selected from: a strip of nonwoven fibrous material, at least one multifilament or cabled monofilament.

15. The press felt according to 14, wherein the high surface contact area material in the seam region of the press felt is maintained within 1 mm of the fixed position.

16. The press felt according to claim 1, wherein the polymeric yarns of the yarn assembly are at least one of single, multicomponent or cabled, and are comprised of a polymer selected from a polyamide and a polyurethane.

17. The press felt of claim 1, wherein an additional one of the generally planar yarn assemblies is located on at least one of an upper external surface of the generally planar flattened tube-like textile structure or a lower external surface of the generally planar flattened tube-like textile structure.

18. The press felt according to claim 1, wherein the generally planar yarn assembly comprises:

a first outside yarn panel, at least one interior yarn panel, and a second outside yarn panel, the first and second outside yarn panels each including multicomponent yarns or other high surface contact area material yarns at an exterior MD edge that extend in a position located adjacent to the CD oriented folds, the multicomponent yarns or other high surface contact area material yarns having a spacing that is the same as the array of mutually parallel and regularly spaced apart polymeric yarns of the interior yarn panel, and the first and second outside yarn panels have a bonded connection to edges of the interior yarn panel.

19. The press felt according to claim 18, wherein the bonded connection is an ultrasonic weld.

20. The press felt assembly according to claim 18, wherein one of the multicomponent yarns or other high surface contact area material yarns in the first outside panel is located in an interior of the first fold region of the base fabric, parallel to, and in contact with interior surfaces of the MD yarn loops at the CD oriented first fold region.

21. The press felt assembly according to claim 20, wherein one of the multicomponent yarns or other high surface contact area material yarns in the second outside panel is located in an interior of the second fold region of the base fabric, parallel to, and in contact with interior surfaces of the MD yarn loops at the CD oriented second fold region.

22. The press felt according to claim 1, wherein a void volume of the press felt is adjustable by adjusting a spacing between yarns in the array of yarns of the generally planar yarn assembly.

23. The press felt according to claim 22, wherein the spacing is adjusted based on an amount of stretching of the elastic carrier material.

24. The press felt according to claim 1, wherein the elastic carrier material is stretched at least 2%.

25. The press felt according to claim 1, wherein the base fabric material comprises a plurality of spirally wound turns of a first fabric structure, the first fabric structure including:

a first planar yarn array of the MD oriented yarns comprising single polymeric monofilaments arranged at a first density, at least two layers of a hot melt adhesive web having a first melting temperature, one of the layers of the hot melt adhesive located on each side of the first planar yarn array, and a layer of a fine fibrous scrim material-located over each of the layers of the hot melt adhesive web, wherein the first yarn array, the two layers of the hot melt adhesive web, and the layers of the fine fibrous scrim material located over the two layers of the hot melt adhesive web are heated above the first temperature to form the first fabric structure, and each adjacent one of the wound turns of the first fabric structure is oriented at an angle to the MD and is bonded to an adjacent turn to provide a flattened continuous double layer tube.

26. The fabric according to claim 25, wherein the fine fibrous scrim material is a thermally bonded nonwoven open network of continuous polyamide fibers having a dtex in the range of 1 to 10, and an air permeability of from about 100 cfm (~1560 $m^3/m^2/hr$) to about 2,000 cfm (~31,000 $m^3/m^2/hr$) or more and which has a second melting temperature that is higher than that of the first melting temperature.

27. The fabric according to claim 25, wherein the yarns of the first array are circular in cross-section and have a first diameter.

28. The fabric according to claim 25, wherein the yarns of the first array are single circular cross-sectional shaped monofilaments having a diameter of 0.2 mm to 0.6 mm arranged at a yarn density of from 15 to 40 yarns/inch (5.9 to 15.7 yarns/cm).

29. The fabric according to claim 25, wherein the CD yarns of the generally planar yarn assembly are single circular cross-sectional shaped monofilaments having a diameter of 0.2 mm to 0.6 mm arranged at a yarn density of from 15 to 40 yarns/inch (5.9 to 15.7 yarns/cm).

30. The fabric according to claim 25, wherein the CD yarns of the generally planar yarn assembly are cabled monofilaments having a diameter, d, in the range of 0.1 to 0.3 mm.

31. The fabric according to claim 30, wherein the cabled monofilaments are cabled in one of a d×2×2, d×2×3 or d×3×3 arrangement.

32. The fabric according to claim 25, wherein the MD oriented yarns of the first array are circular in cross-section and have a first diameter, the CD yarns of the generally planar yarn assembly are circular in cross-section and have a second diameter, and the first diameter is greater than or equal to the first diameter.

33. The fabric according to claim 25, wherein the fibers of the fine fibrous scrim material have a dtex (mass in grams per 10,000 meters of fiber) which is in the range of from about 1 to 10.

34. The fabric according to claim 33, wherein the fibers of the fine fibrous scrim are comprised of polyamide-6/6 (PA-6/6) which are periodically bonded together to form a highly open loosely cohesive scrim material having an air permeability of at least 100 cfm (~1560 $m^3/m^2/hr$).

35. The fabric according to claim 34, wherein the scrim material has a tensile strength of at least 5 lb/in.

36. The press felt according to claim 1, wherein base fabric material comprises a plurality of spirally wound turns of a first fabric structure, the first fabric structure including:

a first array of the MD oriented yarns comprising single polymeric monofilaments and a second array of CD oriented yarns interwoven with the MD oriented yarns in a plain weave, and each adjacent one of the wound turns of the first fabric structure is oriented at an angle to the MD and is bonded to an adjacent turn to provide a flattened continuous double layer tube.

37. A method of making a press felt, comprising:

providing a base fabric including at least lengthwise extending MD yarns arranged in two superimposed layers joined by the MD oriented yarns at CD oriented fold regions, the base fabric having a desired MD length and CD width, the MD oriented yarns forming first loops at a first one of the fold regions and forming second loops at a second one of the fold regions, and the first and second loops are adapted to be interdigitated to define a uniform channel extending the CD width of the press felt;

forming a planar yarn assembly comprising an array of mutually parallel component yarns, by arranging the component yarns mutually parallel and at a desired spacing, and laminating the component yarns to an adhesive web under heat and pressure in a continuous process, and bonding the laminated component yarns to a nonwoven, elastic carrier material, the elastic carrier being stretchable allowing the planar yarn assembly to be stretchable in a direction essentially perpendicular to an orientation of the yarns of the array, the planar yarn assembly extends from one of the fold regions to the opposite fold region of the base fabric in a single layer, and at least some of the component yarns at first and second exterior edges of the planar yarn assembly are formed of a high surface contact area material;

locating the planar yarn assembly interior to the two superimposed layers of base fabric with the first end of the planar yarn assembly extending at least partially into the MD yarn loops at the fold region;

fixing the first end of the planar yarn assembly in position so that a first component yarn is in the desired position adjacent or extending partially into the MD yarn loops of the base fabric, and then stitching, sewing or otherwise bonding the first end to the base fabric;

extending the planar yarn assembly towards the opposite fold region of the base fabric, the MD length of the yarn assembly being at least 1% less than an overall interior flattened length of the base fabric, and uniformly tensioning the planar yarn assembly across its CD width so as to stretch the elastic carrier with the laminated yarns attached to it by an amount sufficient to bring the second end into position adjacent to the seam loops;

clamping the second end of the planar yarn assembly in position so that a last component yarn is in the desired position adjacent or extending partially into the MD yarn loops of the base fabric, and then stitching, sewing or otherwise bonding the second end to the base fabric.

38. The method of claim 37, wherein forming the planar yarn assembly further comprises:

forming a plurality of laminated yarn panels, each including the component yarns that are mutually parallel and at a desired spacing, and assembling a plurality of the yarn panel to form the planar yarn assembly.

39. The method of claim 38, wherein forming the planar yarn assembly further comprises:

arranging lateral edges of each of the yarn panels such that a lap join can be formed in which the component yarn spacing is maintained.

40. The method of claim 39, wherein forming the planar yarn assembly further comprises:

cutting each of the yarn panels to a length equal to the CD width of the base fabric; and connecting together a sufficient number of yarn panels so that, when joined and bonded edge to edge, the planar yarn assembly is at least 1% shorter than the interior flattened MD length.

41. The method of claim 40, wherein forming the planar yarn assembly further comprises:

providing exterior edges of the first and last yarn panels of the planar yarn assembly which will be located adjacent the fold regions of the base fabric with the high surface contact area material.

42. The method of claim 41, wherein the high surface contact area material comprises at least one of a strip of nonwoven fibrous material, a multifilament or a cabled monofilament.

* * * * *

UNITED STATES PATENT AND TRADEMARK OFFICE

CERTIFICATE OF CORRECTION

PATENT NO. : 9,315,940 B2
APPLICATION NO. : 14/390538
DATED : April 19, 2016
INVENTOR(S) : Henry Lee It is certified that error appears in the above-identified patent and that said Letters Patent is hereby corrected as shown below:

IN THE SPECIFICATION

At column 11, line 46, delete "is" and insert therefor -- is a --.

IN THE CLAIMS

In Claim 13, at column 34, line 24, delete "fabric" and insert therefor -- press felt --.

In Claim 15, at column 34, line 34, delete "to 14" and insert therefor -- to claim 14 --.

In Claim 20, at column 34, line 62, delete "felt assembly" and insert therefor -- felt --.

In Claim 21, at column 35, line 1, delete "felt assembly" and insert therefor -- felt --.

Signed and Sealed this
Ninth Day of August, 2016

Michelle K. Lee

Michelle K. Lee
*Director of the United States Patent and Trademark Office*